US010101082B2

(12) United States Patent
Sinko

(10) Patent No.: US 10,101,082 B2
(45) Date of Patent: Oct. 16, 2018

(54) COOLING SYSTEM FOR BEVERAGE DISPENSING SYSTEMS

(71) Applicant: MetaDesign LLC, White Plains, NY (US)

(72) Inventor: Michael Sinko, White Plains, NY (US)

(73) Assignee: METADESIGN LLC, White Plains, NY (US)

( * ) Notice: Subject to any disclaimer, the term of this patent is extended or adjusted under 35 U.S.C. 154(b) by 244 days.

(21) Appl. No.: 14/734,502

(22) Filed: Jun. 9, 2015

(65) Prior Publication Data

US 2015/0354886 A1 Dec. 10, 2015

Related U.S. Application Data

(60) Provisional application No. 62/009,642, filed on Jun. 9, 2014.

(51) Int. Cl.

| | |
|---|---|
| ***F25D 31/00*** | (2006.01) |
| ***F25D 15/00*** | (2006.01) |
| ***F25D 17/02*** | (2006.01) |
| ***B67D 1/08*** | (2006.01) |

(52) U.S. Cl.

CPC ..... *F25D 31/006* (2013.01); *B67D 1/0867* (2013.01); *B67D 1/0884* (2013.01); *F25D 15/00* (2013.01); *F25D 17/02* (2013.01); *B67D 2210/00104* (2013.01); *F25D 2700/16* (2013.01)

(58) Field of Classification Search

CPC ..... F25D 31/006; F25D 17/02; F25D 15/00; F25D 2700/16; F25D 31/002; F25D 3/08; F25D 31/007; B67D 1/0884; B67D 1/0867; B67D 2210/00104; B67D 1/0864; B67D 1/0857

See application file for complete search history.

(56) References Cited

U.S. PATENT DOCUMENTS

| | | | | |
|---|---|---|---|---|
| 2,003,050 A * | 5/1935 | Iselin | F25D 3/02 | 222/131 |
| 3,443,397 A * | 5/1969 | Donovan | F25D 3/02 | 62/398 |
| 4,071,160 A * | 1/1978 | Vick | B65D 81/3886 | 206/514 |
| 4,653,290 A * | 3/1987 | Byrne | F25D 3/08 | 383/38 |
| 4,730,463 A | 3/1988 | Stanfill | | |

(Continued)

*Primary Examiner* — Emmanuel Duke
(74) *Attorney, Agent, or Firm* — Leason Ellis LLP

(57) ABSTRACT

A cooling system for a beverage dispensing system includes a cooling jacket for placement around a beverage container, such as a keg. The cooling jacket includes a main body having a top edge, an opposite bottom edge, an inner surface and an opposing outer surface. The main body is configured for placement around a side of the container. The main body has a first interior space for receiving the container, wherein the main body is formed of a first insulation material. The cooling jacket also includes an openable and closeable upper body that is for placement above and over a top of the container. The upper body is coupled to the main body such that is lies thereabove. The upper body is formed of a second insulation material. The upper body has a means for closing the upper body for completely enclosing the container within the cooling jacket.

17 Claims, 20 Drawing Sheets

(56) References Cited

U.S. PATENT DOCUMENTS 4,802,344 A * 2/1989 Livingston ..... A45F 3/16 62/372
4,869,396 A 9/1989 Horino et al.
4,963,175 A * 10/1990 Pace ..... A47G 23/04 62/372
5,279,446 A 1/1994 Cook et al.
5,361,605 A 11/1994 Pizzi et al.
5,564,568 A * 10/1996 Rankin, Sr. ..... B65D 81/3886 206/446
5,913,454 A 6/1999 McHale
5,934,100 A * 8/1999 Hornick ..... B65D 81/3883 62/371
5,974,824 A 11/1999 Galockin et al.
6,010,043 A 1/2000 Williamson et al.
6,082,896 A * 7/2000 Pulli ..... B65D 81/3897 383/110
6,405,555 B1 * 6/2002 Rowland ..... B67D 1/0861 62/389
6,598,417 B1 7/2003 Wilkes
6,729,758 B1 * 5/2004 Carter ..... B65D 29/02 220/592.19
6,775,996 B2 8/2004 Cowans
7,191,614 B2 3/2007 Hess et al.
7,370,776 B2 5/2008 Gomi
7,373,784 B2 5/2008 Haskayne
7,389,647 B1 6/2008 Abraham, III
7,516,623 B2 4/2009 Hall, Sr.
7,721,567 B2 5/2010 Dalton et al.
7,823,411 B2 11/2010 Gagliano et al.
8,091,378 B1 1/2012 Farias, III et al.
8,387,826 B2 3/2013 Tsubouchi et al.
2003/0074903 A1 * 4/2003 Upadhye ..... A47J 36/2438 62/3.3
2005/0097913 A1 * 5/2005 Hess ..... A23G 9/045 62/340
2010/0326123 A1 * 12/2010 Johnson ..... F25D 31/006 62/457.9

* cited by examiner

COOLING SYSTEM FOR BEVERAGE DISPENSING SYSTEMS

CROSS-REFERENCE TO RELATED APPLICATION

The present application claims the benefit of U.S. patent application Ser. No. 62/009,642, filed Jun. 9, 2014, which is hereby incorporated by reference in its entirety.

TECHNICAL FIELD

The present invention is generally directed to beverage dispensing systems and more particularly, to a complete cooling system, including a cooling jacket, for use in a beverage dispensing system, such as a beer dispensing system that consists of one or more kegs of beer or a wine dispensing system.

BACKGROUND

Beverage dispensing systems are configured for dispensing beverages on demand from a beverage source. Beverage dispensing systems are typically used in commercial settings, such as restaurants and bars. These beverage dispensing systems can dispense not only non-alcoholic beverages but also alcoholic beverages, such as beer or wine. The dispensing of beer and other beverages from kegs is well known and keg beer provides an economic method of packaging beer and delivering it to consumers on demand.

Since beverages are most often delivered in a chilled state, the source of the beverage, such as a beer keg or wine, must be chilled in order to deliver it in a chilled state. Cooling of beer kegs can be accomplished in any number of different ways including less complex ways such as immersing the beer keg in a container that includes ice. However, this practice is somewhat inconvenient, messy and involves considerable effort and labor both before and after use.

Other attempts have been made to maintain a cooled temperature of the liquid of the keg container and beverage dispensing system. However, these attempts have associated deficiencies including that only a portion of the beverage dispensing system is actively and adequately cooled, thereby leaving other portions of the dispensing system unchilled and/or inadequately chilled. In the case of beer, as the beer flows through these unchilled regions, the temperature of the chilled beer rises and this results in foam being formed when a user operates the dispensing system (such as at a keg tap). The production of foam is most often caused by the beer keg and/or beer in the dispensing lines being exposed to too warm a temperature resulting in heating of the beer and foaming.

More particularly, most establishments serve more than one type (brand) of beer and therefore, there are multiple kegs, each containing one type of beer. These multiple kegs are often times cooled by placing all of the kegs in a single refrigerated area, such as a walk-in-refrigerator or kegerator. Alternatively, there are cooling jackets that can be disposed about each keg for cooling thereof. The jackets circulate a cooling fluid about a surface of the jacket. However, these systems suffer from a number of deficiencies including that at best they only cool select portions of the overall system, thereby leaving the other portions exposed to room temperatures. Even placement of insulation along lines does not sufficiently chill the beer flowing therein. Since the beer is not cooled along the entire length of the dispensing pathway, the temperature of the beer becomes elevated and foam results when the beer is dispensed. As described below, the cooling system 100 of the present invention overcomes these disadvantages.

Some of the existing systems for cooling a liquid include direct draw systems (kegerators). However, kegerators have the following deficiencies: (1) they are bulky, and take up a lot of valuable space; (2) tap towers are not actively and/or adequately cooled or temperature controlled; (3) all kegs are cooled to the same temperature; and (4) kegs are difficult to access. Other systems include long draw systems (walk-in refrigerator); however, these systems suffer from the following deficiencies: (1) require a lot of space; (2) kegs are vulnerable to temperature fluctuations if people frequently enter the refrigerator; (3) all kegs are cooled to the same temperature; and (4) no temperature control on the trunk line or tap tower.

Other existing systems include jacketed cooling systems; however, these systems suffer from the following deficiencies: (1) all kegs are cooled to the same temperature; (2) kegs are cooled in series; (3) the entire path of the beer line is not chilled and/or insulated; and (4) no temperature control on the trunk line or tap tower.

Other cooling solutions that have been tried include but are not limited to: (1) the use of an insulating jacket (no active cooling); (2) insulating jacket with ice packs of some other frozen material; and (3) a "Jockey Box" (kegs are not cooled but beer passes through coil immersed in ice water).

There is therefore a need for providing a more comprehensive cooling system for a beverage dispensing system (e.g., beer dispensing system) that is completely temperature controlled, configured to cool the beverage along its entire path from the beverage source to the point of dispensing to the consumer, as well as having the capability to cool and maintain each keg at different temperatures.

SUMMARY

A cooling system for use with a beverage dispensing system that includes a beverage source, a dispenser and a fluid line that extends between the beverage source and the dispenser is described herein. The cooling system includes a source of coolant and an insulated distribution device (distribution box) that includes a manifold structure that is operatively connected to the source of coolant by a first line that receives chilled coolant from the coolant source and a second line that returns coolant to the source. The manifold structure includes a main controller for controlling a flow of the coolant through the manifold structure.

The cooling system also includes an insulated feeder line that extends between the distribution device (box) and the beverage source. The insulated feeder line contains: (a) a first branched line that is in fluid communication with the first line and carries chilled coolant to the beverage source; (b) a second branched line that is in fluid communication with the second line and returns the coolant to the coolant source; and (c) a first beverage line; and (d) a gas supply line.

The cooling system also includes an insulated trunk line that extends between the distribution box and the dispenser. The insulated trunk line contains: (a) a third branched line that is in fluid communication with the first line and carries chilled coolant to the dispenser; (b) a fourth branched line that is in fluid communication with the second line and returns the coolant to the coolant source; and (c) the first beverage line.

The first beverage line is chilled the entire length from the beverage source to the dispenser by: (a) the chilled coolant flowing within the first branched line of the beverage feeder line; (b) flowing within the insulated distribution box; (c) the chilled coolant flowing within the third branched line of the trunk line; and (d) the chilled coolant flowing within the insulated tap tower and cooling block therein.

In accordance with one embodiment, the cooling jacket includes an openable and closeable main body having a top edge, an opposite bottom edge, an inner surface and an opposing outer surface. The main body is configured for placement around a side of the container. The main body has a first interior space for receiving the container, wherein the main body is formed of a first insulation material contained within protective shell. The cooling jacket also includes an openable and closeable upper body that is for placement above and over a top of the container. The upper body is coupled to the main body such that is lies thereabove (alternatively, the upper body can be integral to the main body). The upper body is formed of a second insulation material contained within protective shell. The upper body has a second interior space for necessary keg connections. The upper body has a means for closing the upper body for completely enclosing the container within the cooling jacket.

BRIEF DESCRIPTION OF THE DRAWING FIGURES

DETAILED DESCRIPTION OF CERTAIN EMBODIMENTS

Figure 1:
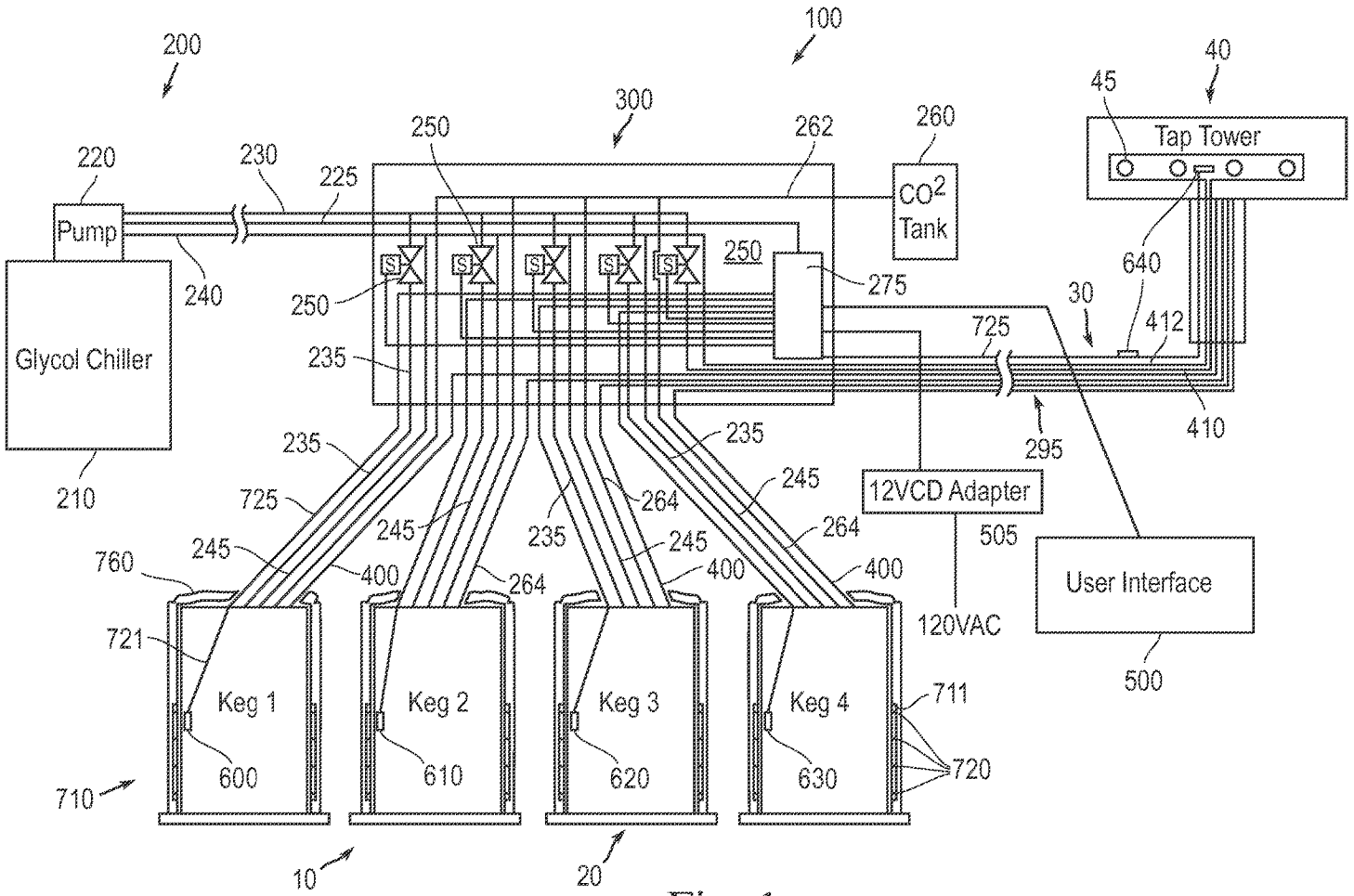
FIG. 1 is a schematic of a cooling system according to a first embodiment for use with a beverage dispensing system.
Figure 2:
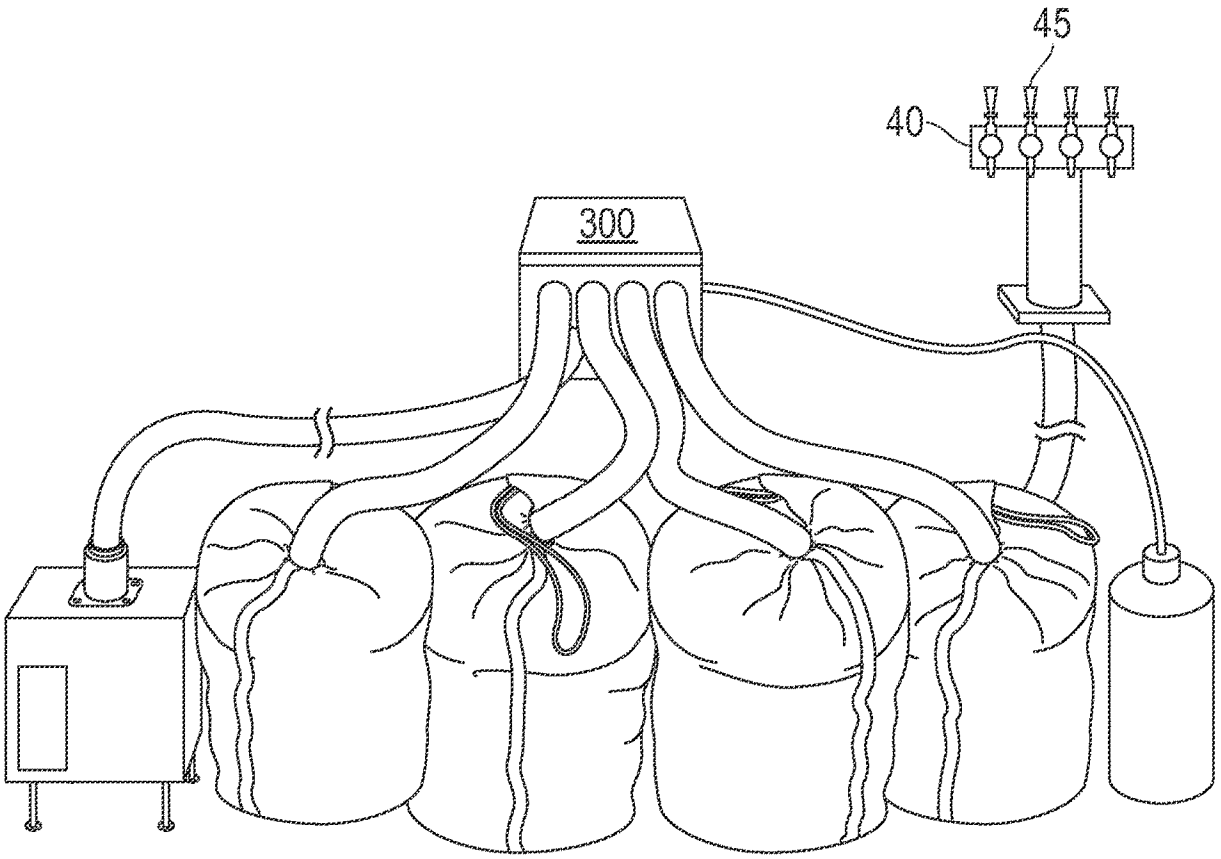
FIG. 2 is a perspective view of the cooling system operatively coupled to the beverage dispensing system.
Figure 3:
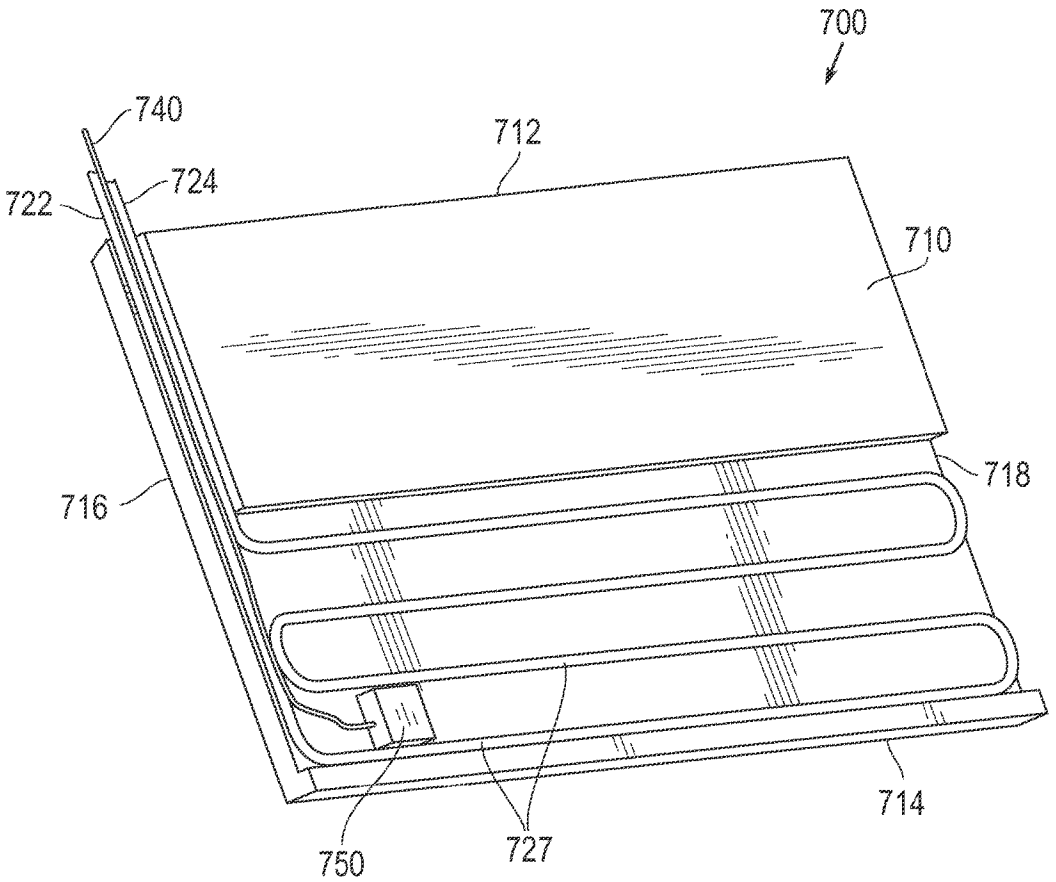
FIG. 3 is a rear perspective view of a cooling jacket that is part of the cooling system.

FIG. 1 is a schematic of a cooling system 100 according to a first embodiment for use with a beverage dispensing system 10. The beverage dispensing system 10 includes components that are configured to store and deliver a liquid beverage to a particular location at which it is dispensed to a person (consumer). Generally speaking, the system 10 includes a beverage source 20, a conduit 30 and a dispenser 40. The conduit 30 delivers the liquid beverage from the source 20 to the dispenser 40. One exemplary beverage dispensing system 10 is in the form of a beer dispensing system in which beer in one or more kegs (beverage source 20) is delivered to a dispensing location (dispenser 40). However, it will be appreciated that the beverage dispensing system 10 can alternatively be in the form of a wine dispensing system or other type of system that dispenses a beverage.

As is known, the beer keg 20 is typically formed of a metal material, such as stainless steel. The keg 20 has a single opening 22 on one end and a tube called a "spear" extends from the opening to the other end. There is a self-closing valve that is opening by a coupling fitting 50 which is attached when the keg 20 is tapped. There is also an opening at the top of the spear that allows gas (usually carbon dioxide) to drive the beer out of the keg 20. The coupling fitting (keg coupler) 50 has one or two valves that control the flow of beer out of and gas into the keg 20. The keg 20 must be in the upright position, with the opening on top, for the beer to be dispensed.

The dispenser 40 can be in the form of a tap tower (draft tower). The tap tower 40 is configured such that each of the lines (trunk lines) from the kegs 20 is operatively connected to respective faucets 45 at the dispenser 40 for dispensing the individual beers. Thus, operation of one faucet 45 dispenses one type of beer at the dispenser 40.

The cooling system 100 is formed of a number of different sub-systems or sub-assemblies (components) that are operatively connected to one another to cool the liquid beverage (e.g., beer or wine) not only at its source (keg 20) but also along the entire line (flow path) to the dispenser 40 as described below. The cooling system 100 includes a coolant sub-assembly 200 formed of a coolant chiller 210 that contains a coolant (such as glycol or other suitable coolant) and a pump 220 that pumps chilled coolant from the chiller 210 and draws spent coolant into the chiller 210 thereby forming a continuous coolant loop. The chiller 210 can take a conventional form and include a compressor and other cooling equipment used to chill the coolant to the desired temperature.

In one embodiment, the glycol is chilled to a temperature of below 20° F., such as about 17° F.

The coolant sub-assembly 200 has a least one first coolant line 230 for carrying chilled coolant away from the chiller 210 and at least one second coolant line 240 for carrying spent coolant back to the chiller 210. The line 230 is thus in the form of a coolant send line and the line 240 is thus in the form of a return line. The pump 220 is operably connected to the chiller 210 and serves to pump the coolant through the coolant lines 230, 240. The pump 220 can be controlled so as to run the coolant (glycol) continuously or to pulse the coolant.

Figure 13:
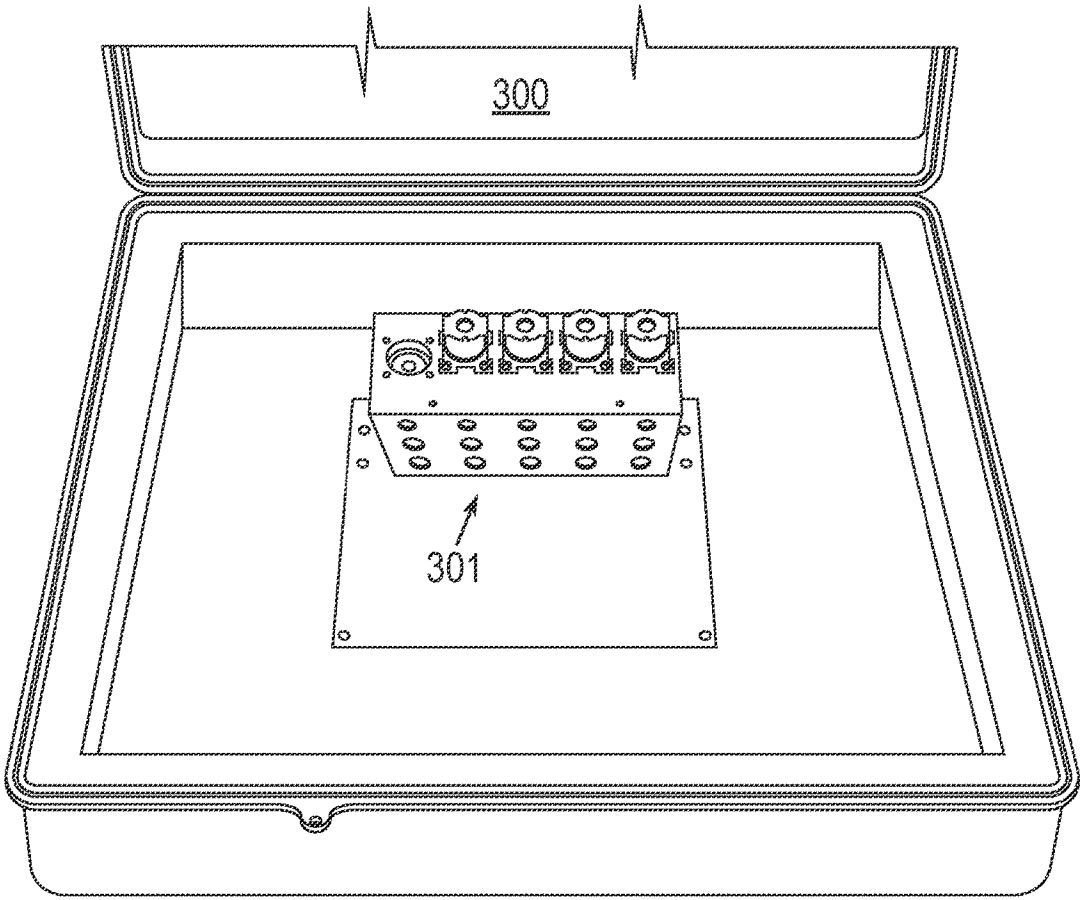
FIG. 13 is a top view inside an exemplary distribution box showing an exemplary manifold.

The cooling system 100 includes a central distribution device 300 that includes a central manifold 301 (FIG. 13) which serves as a central apparatus for routing the coolant but and further, the chilled distribution device (box) itself is cooled and therefore the beverage that flows therethrough is also chilled.

In accordance with the present invention, the central distribution device (distribution box) 300 (including the manifold 301) is insulated so as to control and maintain the temperature within the device 300 to within a target range (chilled range). Coolant flows through the device (distribution box) 300 and thus serves as a means for lowering the internal temperature within the device 300. The device 300 can be insulated using conventional insulation material that lines the inside of the device 300 to capture and hold the chilled temperature. The coolant lines are disposed within the interior of the device 300 and serves to cool the interior of the device 300.

As mentioned above and as shown in FIGS. 1 and 13, the device 300 contains a manifold structure 301 which distributes the coolant from the chiller 210 to the individual kegs 20. In other words, the line 230 from the chiller 210 branches off into a plurality of first branched lines 235 that are part of keg feeder lines as discussed herein. Each first branched line 235 is in fluid communication with the line 230 and delivers the chilled coolant to one respective keg 20 for cooling thereof. Each first branched line 235 includes a valve (coolant control valve) 250 which is disposed therein for controlling the flow of the coolant through the first branched line 235. The valve 250 is preferably both a programmable and controllable valve; however, a manual valve 250 can be used, such as a one-way valve. In particular, the valve 250 is in communication with a main controller 275 that can operably control the valve 250. The valve 250 can be in the form of any number of different types of valves including but not limited to solenoid valves, etc. In this manner, the main controller 275 controls the flow of coolant to the selected kegs 20 that are "active" or "on-line". Those kegs 20 that are active require the coolant to be pumped to the kegs 20 for cooling thereof. The first branched line 235 can thus be thought of as being an inlet or delivery line that delivers the coolant to the keg 20.

The main controller 275 also is operatively connected (via control line 225) to the pump 220 and serves to control operation of the pump 220. The main controller 275 can thus control the pumping of the coolant throughout the various coolant lines, such as lines 230, 240.

Similarly, the return line 240 which returns the spent coolant to the chiller 210 in likewise branched within the device 300. More specifically, the return line 240 branches off into a plurality of second branched lines 245 that are part of the keg feeder lines as discussed herein. Each second branched line 245 is in fluid communication with the line 240 and delivers the spent coolant from the keg 20 to line 240 and then the chiller 210 for regeneration of the coolant. Since each second branched line 245 is a return line, there is no valve. The second branched line 245 can thus be thought of as being a return line that returns the spent coolant to the chiller 210.

A gas source 260 is provided for driving the beer out of each keg 20. The gas source 260 is typically carbon dioxide (tank format), nitrogen or a mix thereof, with a gas line 262 delivering the gas to the kegs 20. Since there are more than one keg 20, the gas line 262 can be branched into branched gas lines 264 from the main gas line 262, with each keg 20 having its own gas branched gas line 264 for delivering the gas to the respective keg 20.

It will therefore be appreciated that the manifold 301 is disposed within the insulated and temperature controlled distribution box 300 and the manifold 301 is thus a separate part that is designed to route fluid from one location to another location. The manifold 301 can be a block that has a plurality of conduits formed therein to route coolant according to desired flow paths.

As described below, a keg feeder line 290 (FIGS. 7 and 9) is provided for containing the various lines. In other words, the keg feeder line 290 contains a bundle of individual fluid and gas lines that are packaged within a protecting sleeve or jacket as described below.

The beer that is driven out of the keg 20 by means of the gas then travels in a beer line 400 which delivers the beer to the dispenser 40. Unlike the other lines, the individual beer lines 400 are not part of a branched line network since each beer line 400 carries its own beer to the dispenser 40. The beer line 400 travels through the bundled keg feeder line 290 through the device (distribution box) 300 and then upon exiting the device 300, the individual beer lines 400 are bundled together within a trunk line 295 which is similar to the keg feeder line 290 and has a sleeve or jacket that contains the beer lines 400. In the illustrated embodiment, there are four beer lines 400 since there are four beer kegs 20 and thus, the trunk line 295 contains the four bundled beer lines 400 along with cooling lines (coolant) as discussed herein.

In terms of the cooling of the trunk line 295, there is a coolant line 410 that is actually the last branched line 235 off of the main coolant line 230 (i.e., it is connected to the manifold 301 and receives fluid therefrom). The coolant line 230 thus includes valve 250 for controlling flow of the coolant to the dispenser 40 (tap tower). After exiting the device 300, the coolant line 410 is bundled with the beer lines 400 as part of the trunk line 295 for cooling of the beer lines 400 as they are delivered to the dispenser 40. A return line 412 can be in the form of one of the second branched lines 245 that returns the spent coolant from the dispenser 40 (and trunk line 295) back to the chiller 20 for chilling of the coolant (i.e., the return line 412 is thus connected to the manifold 301). The return line 412 is also bundled as one line of the trunk line 295.

As mentioned herein, the system 100 is a programmable system and includes a number of controllable components that allow the user to not only set the cooling temperatures of the individual beers (i.e., individual kegs 20) but also provides real-time feedback to the user concerning the operating conditions, including real-time temperature measurements. In one exemplary embodiment, the control system 100 includes a user interface 500 that is configured to allow the user to input information that controls the operation of the system (control information) and also the user interface 500 can be configured to display certain information to the user (display information), such as temperature information which reflect operating temperatures of the different components of the system at different locations thereof. The user interface 500 can include conventional input means, such as a keyboard or other types of inputs, such as button, knobs, etc. The user interface 500 can also include a display, such as an LCD display, with or without a touch screen. Alternatively, information can be displayed at other locations remote from the user interface 500.

A power source 505 is provided and is operatively connected to the main controller 275 for powering thereof. The power source 505 can include a 12 VDC and a 120 VAC plug for plugging into an appropriate electrical outlet.

In FIG. 1, the user interface 500 is operatively connected to the main controller 275 that is located inside the device 300. The main controller 275 is then operatively connected to one or more types of sensors and also to working components of the system. For example, the main controller 275 is operatively connected to the pump 220 that is associated with the coolant chiller for controlling operation of the pump 220 (e.g., pump speed, etc.) and delivering the coolant throughout the system 100.

Figure 10:
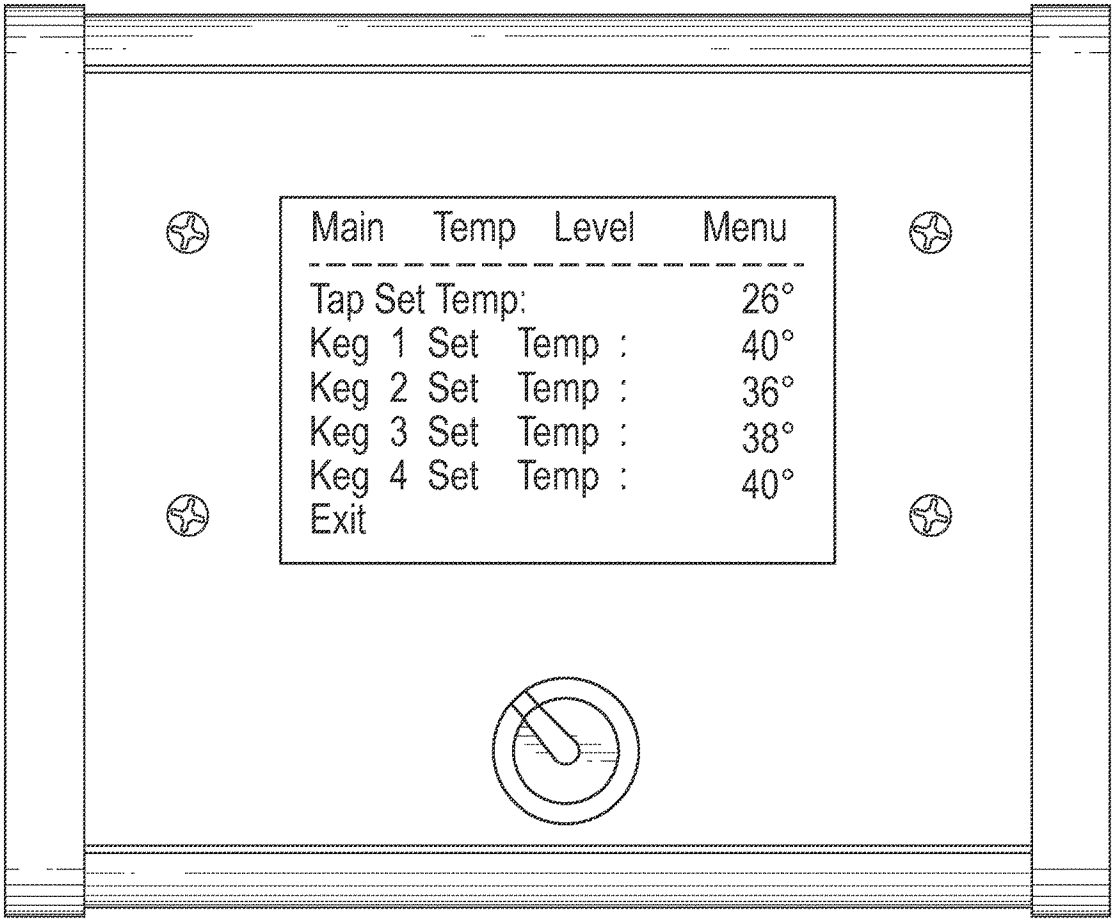
FIG. 10 is a schematic showing an exemplary display indicating set temperatures for individual kegs.

FIG. 10 shows one exemplary display 510 (such as an LCD display) that displays temperature information associated with each of the kegs 20. The display 510 can include controls 512, such as a keyboard or mouse or click wheel, that allow the user to scroll through certain menus, etc. In the illustrated display, the set temperatures at different locations are displayed and in particular, the temperature at or near the dispenser 40 (tap set temperature) that has been set by using the user interface 500 is displayed (in this case 26° F.) and each set temperature of each keg 20 is displayed (in this case, keg 1 has a set temperature of 40° F., keg 2 has a set temperature of about 36° F., keg 3 has a set temperature of about 38° F., and keg 4 has a set temperature of about 40° F.). In addition to displaying the set (programmed) temperature, the display 510 can also display the recorded, real-time temperatures observed at these locations throughout the system 100.

In the illustrated schematic of FIG. 1, there is a plurality of temperature sensors distributed throughout the system 100 for sensing, in real-time, temperatures at various locations of the system 100. For example and as described in more detail herein, a first temperature sensor 600 is associated with a first keg 20; a second temperature sensor 610 is associated with a second keg 20, a third temperature sensor 620 is associated with a third keg 20; and a fourth temperature sensor 630 is associated with a fourth keg 20. A fifth temperature sensor 640 is also provided within the trunk line 295 at or near the dispenser 40 or can even be located within the dispenser 40 itself or both. Each of the temperature sensors is in communication with the main controller 275 which processes the signals and displays the temperature information, such as on display 510. The specific locations of the temperature sensors 600, 610, 620, 630 are discussed below. All of the sensors can be same or can be different.

Now turning to FIGS. 3-6 in which a cooling jacket 700 is shown. The cooling jacket 700 is intended for installation about one keg 20. The cooling jacket 700 includes an outer cover 701 that is configured to hold insulation bodies as described below and as described below can include separate spaces for insulation. The cooling jacket 700 has an insulation body 710 that has a top edge 712, a bottom edge 714, a first end 716, and an opposite second end 718. The insulation body 710 is contained within the outer cover 701. In addition, the cooling jacket 700 has an exterior face or surface 725 and an opposite interior face or surface 730 that faces the keg 20.

The body 710 has a cooling line (coil) 720 that is disposed therein and is routed throughout the body 710. The cooling line 720 has a first end 722 and an opposite second end 724. The first end 722 can include a first connector and the second end 724 can include a second connector. The cooling line 720 can be disposed along the interior surface 730 itself or can be disposed internally within the body 710 in close proximity to the interior surface 730 (i.e., slightly countersunk in the body 710). The ends 722, 724 can be disposed proximate one another along the top edge 712 and in particular, can be located near the end 716.

The coil shape (e.g., serpentine in this one embodiment) of the cooling line 720 increases the heat transfer surface throughout the body 710 resulting in the coolant being in contact with a greater surface area of the keg 20 resulting in chilling thereof. The cooling line 720 can thus assume a serpentine shape and be defined by a plurality of parallel cooling line sections 727 connected by end curved sections 725. The cooling line 720 is thus constructed such that the coolant enters the first end 722 and flows through the cooling line 720 before exiting the end 724.

The jacket body 710 also includes one temperature sensor 600, 610, 620, 630 for monitoring the temperature within the jacket body 710 which is thus indicative of the temperature of the keg 20. Each temperature sensor 600, 610, 620, 630 includes a sensor element 750 that is disposed along the interior surface 730 and a temperature sensor line 721 (FIG. 1) that connects the sensor element 750 to a first sensor connector 740. Another temperature sensor line 725 (FIG. 1) extends between the main controller 275 and has a second temperature sensor connector 742 formed at a distal end thereof. The two connectors 740, 742 mate together such as by a male/female type connection (i.e., a plug type connection). The temperature sensor connector 740 extends upwardly and outwardly from the top edge 712. In the illustrated embodiment, the sensor element 750 lies between two parallel cooling line sections 727. The temperature sensor connector 740 can be disposed proximate the first and second connectors at ends 722, 724.

The first and second connectors at ends 722, 724 and sensor connectors 740, 742 provide a quick connect cooling jacket in that the necessary connections to be made between the operable parts, such as the electronics and the coolant, and the jacket body 710 can be done easily and quickly. Part of one or more of the sensor connector 740, the sensor element 750 and temperature sensor line 721 can lie within the body 710 itself.

As discussed below, the fifth temperature sensor 640 associated with the trunk line 295 or the dispenser 40 can have the same sensor construction as described above with respect to the other temperature sensors 600, 610, 620, 630.

In accordance with one aspect of the present invention, the cooling elements, in this case, the cooling line 720 are at least substantially located in a lower portion of the jacket body 710. More example, most of the cooling line 720 (except for proximal and distal end portions thereof) is located in a lower half of the body 710 (as measured with respect to the height of the body 710). In another embodiment, it can lie within a lower third of the body 710. However, it will be appreciated that in other embodiments, the cooling line 720 is disposed throughout the entire body 710.

The placement of the cooling line 720 in the lower half of the jacket body 710 results in optimal cooling for some beverages, including some beers. More specifically, some beers have maximum density (i.e., are the heaviest) at around 39° F. and therefore, as in the present invention, when the jacket body 710 and thus the keg 20 are cooled to temperatures below 40° F., the beer actually rises in the keg since the warmer beer is more dense. The warmer beer thus lies generally at the bottom of the keg 20. Locating the cooling line 720 in the lower half of the jacket body 710 thus places the active cooling elements in the section of the jacket body 710 adjacent the portion of the keg that contains the warmer beer and thus is in more need for cooling. In other words, this type of jacket construction thus optimizes cooling by placing the active cooling line 720 adjacent the warmest temperature beer in the keg 20. This type of arrangement of the cooling lines creates convective currents of the beer within the keg 20. The cooled beer thus rises and the cooling line 720 operates on the sinking warm beer. A cycle of slightly warmer and slightly cooler beer thus exists in the inside of the keg 20.

Figure 4A:
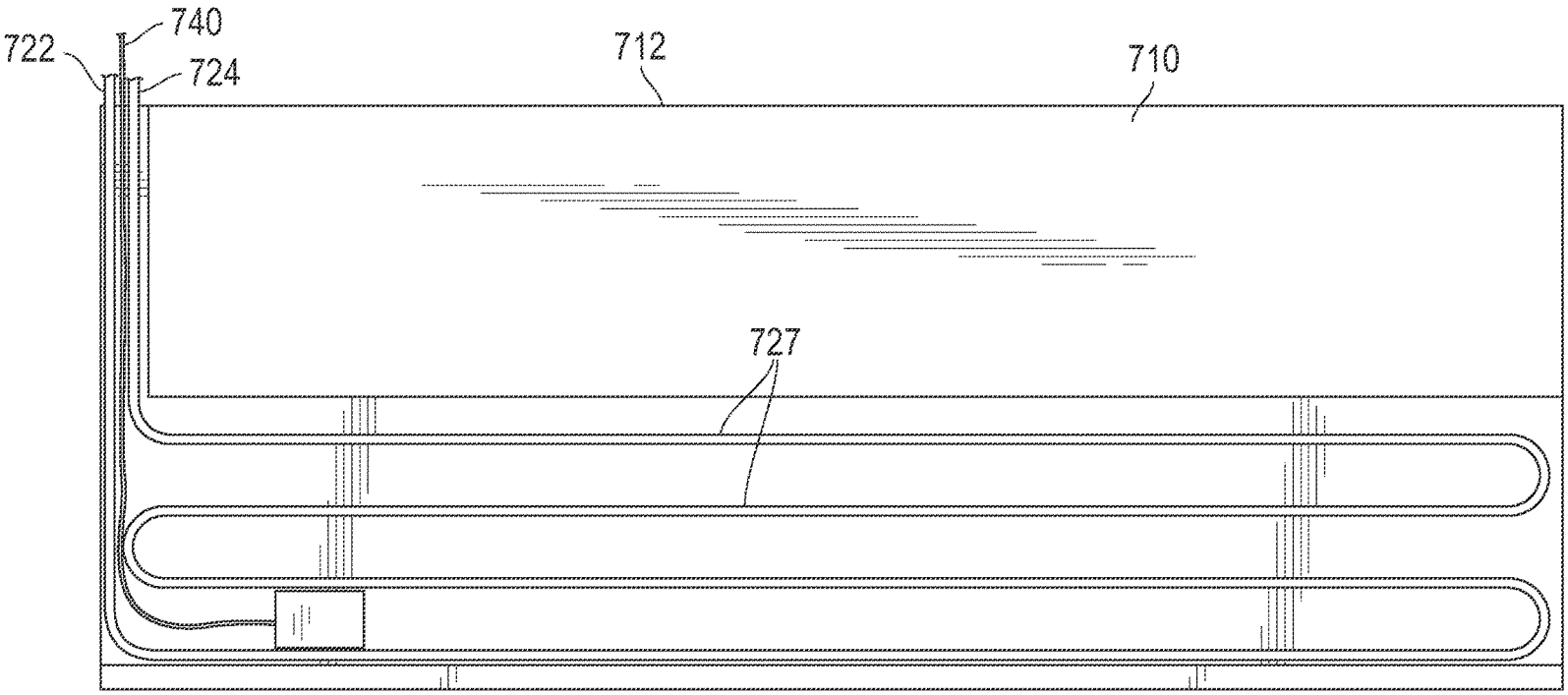
FIG. 4A is a rear elevation view of one cooling jacket.
Figure 4B:
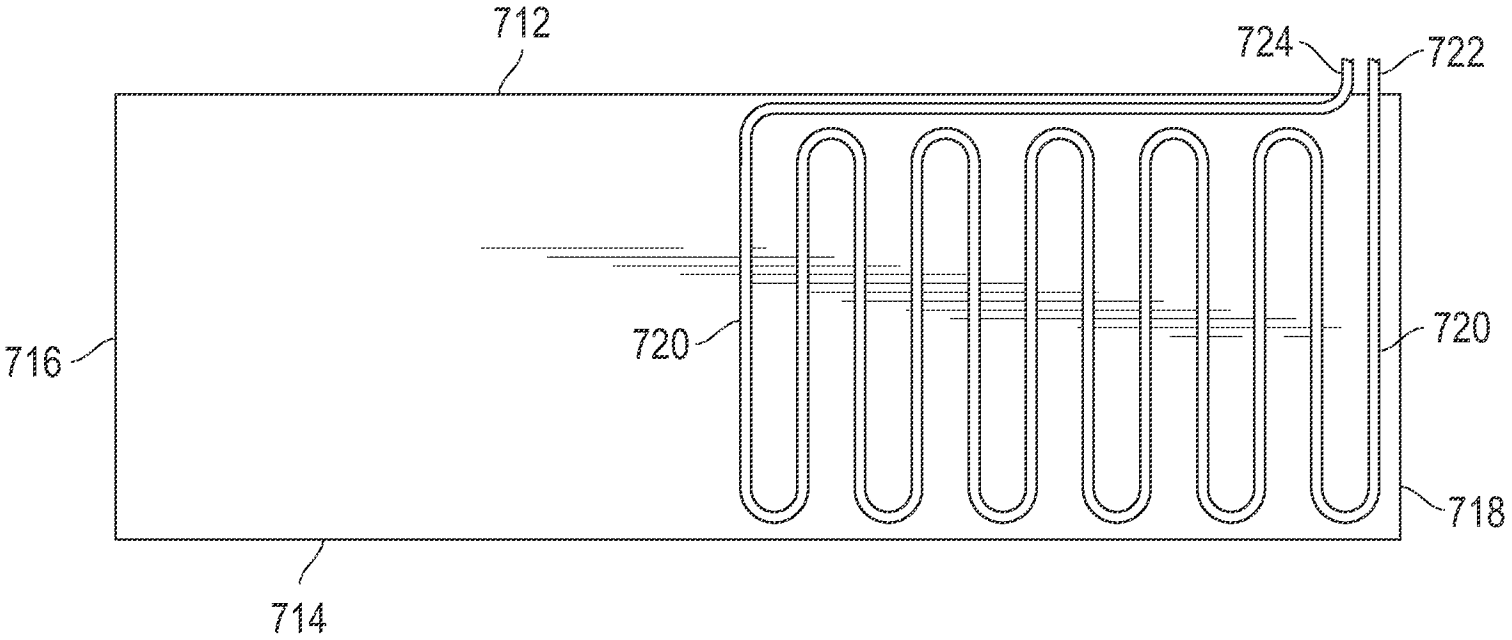
FIG. 4B is a rear elevation view of another cooling jacket.

In an alternative embodiment shown in FIG. 4B, the cooling line 720 can be located on only a portion of the overall body 710 but extends from the top edge 712 to the bottom edge 714. In other words, only a portion of the body from the top edge to the bottom edge includes the cooling line 720 and the remaining portion of the body from the top edge to the bottom edge includes no cooling line 720. Likewise, this arrangement creates convective currents of the beer within the keg 20. Thus, FIG. 4A can be thought of as having a horizontally arranged cooling region and non-cooling region (located in stacked relationship); while FIG. 4B can be thought of as having a vertically arranged cooling region and non-cooling region (located side-by-side).

Figure 4C:
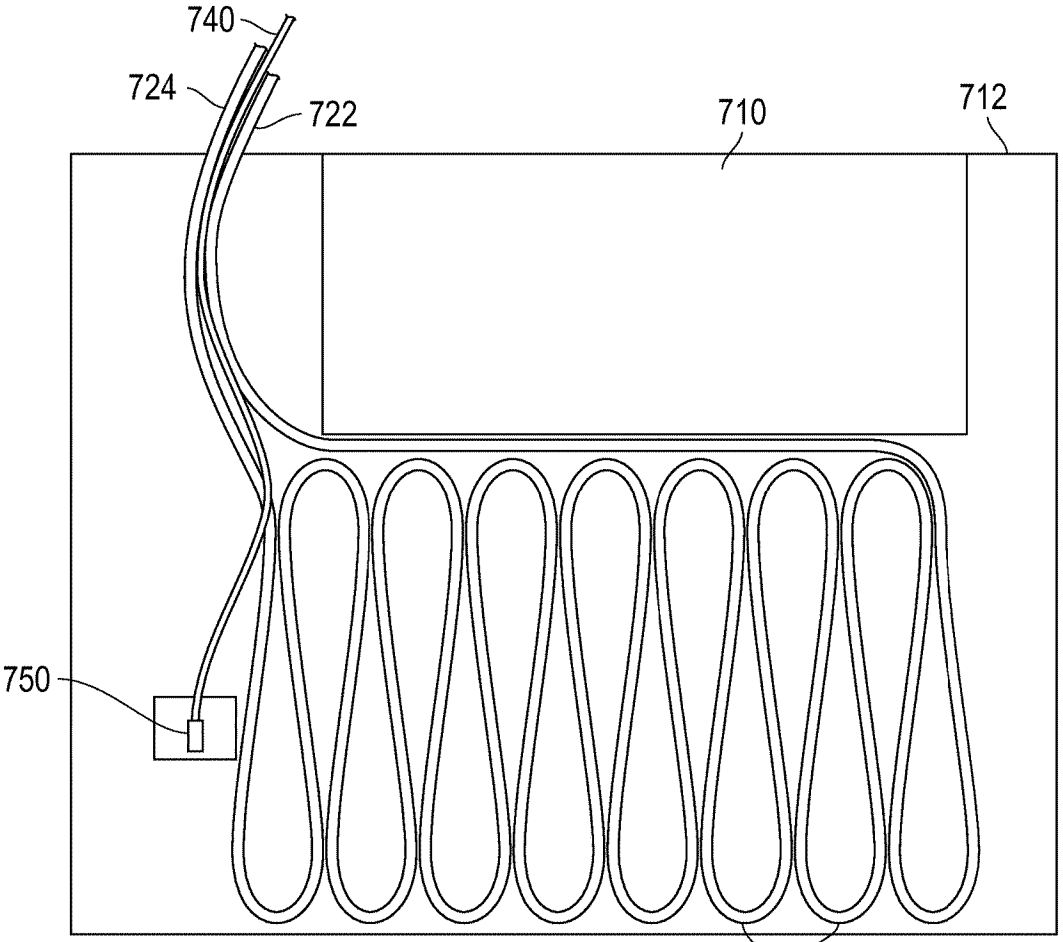
FIG. 4C is a rear elevation view of yet another cooling jacket.

FIG. 4C shows an alternative cooling jacket and in particular, shows an alternative coil design. The coil design is similar to the coil design of FIG. 4B. The cooling line 720 assumes a serpentine pattern; however, the cooling line 720 in FIG. 4C defines a series of tear drop shaped line sections. In particular, the cooling line 720 is looped at ends 725 of the coiled sections; however, linear portions of the taper inwardly (are non-parallel) and are brought into close proximity or even contact with the adjacent section of the cooling line 720. The nesting of the coiled loops creates increased density of cooling lines 720 in a given space. The other parts of this jacket design are similar to the other jacket designs described herein.

The body 710 is formed of a flexible insulation material which allows the body 710 to be wrapped around the outside of the keg 20. In one embodiment, the body 710 is formed of elastomeric foam insulation (foam panels).

Figure 5:
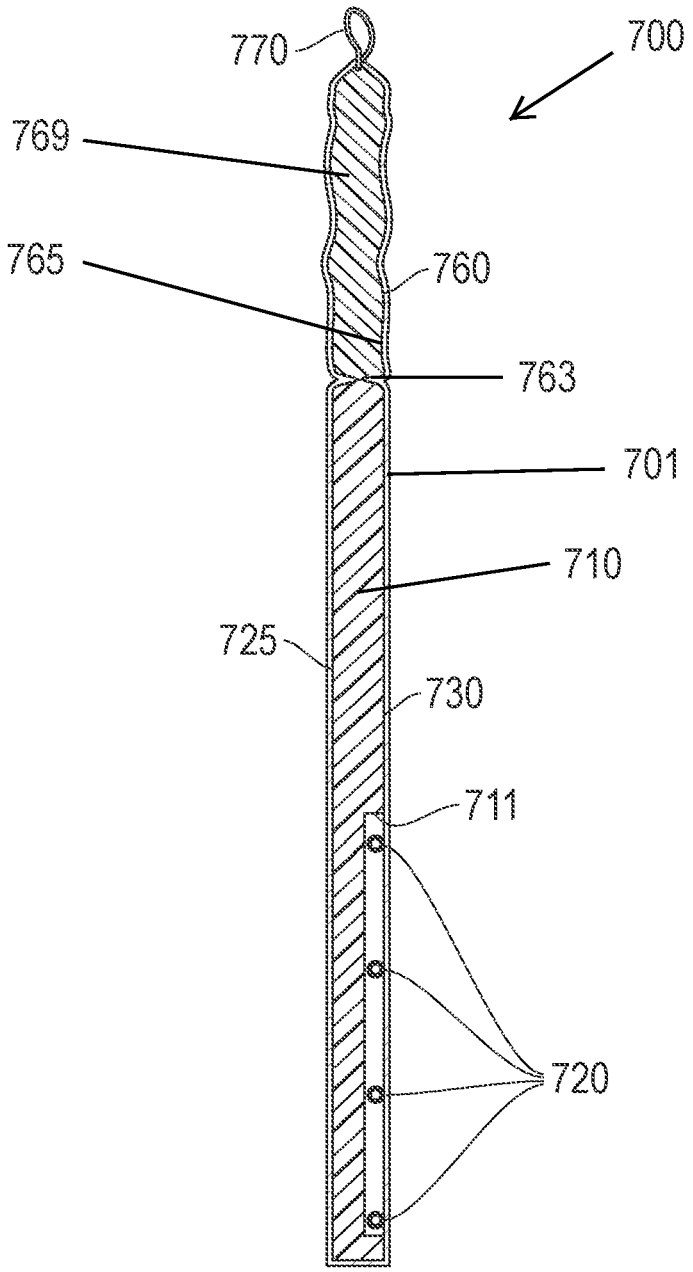
FIG. 5 is a cross-sectional view of the cooling jacket.

FIG. 5 shows a cross-section of the body 710. As shown in FIG. 5, the lower portion of the body 710 can include a cut out 711 in which the cooling line 720 and the sensor element 750 can be located (countersunk) and thus they do not protrude beyond the rear surface of the body 710 located above the cut out 711.

In addition, the cooling jacket 700 includes a closeable top portion 760 which is coupled to the main body 710 and forms part of the outer cover 701. The closeable top portion 760 is designed to be disposed above the top of the keg 20 and is openable/closeable to allow the keg coupler 50 and keg feeder line 290 to be received within the cooling jacket 700 to make the necessary connection to the keg coupler 50 of the keg 20. The lines 235, 245 are contained within this closeable top portion 760 and are preferably laid across the top of the keg 20, thereby providing a chilling action to the keg top and the enclosed area above. As a result, the keg 20 is cooled along its side by the cooling line 720 and along its top by the line 235 that extends thereacross.

The closeable top portion 760 has a means 770 for opening and closing the top portion 760. For example, the means 770 can be in the form of a cinching means that can be tightened and loosened in order to close or open, respectively, the top portion 760.

Since the closeable top portion 760 is designed to bend and overlie the top of the keg, the closeable top portion 760 is formed of a pliable material that can be bent and formed so as to overlie and cover the top of the keg 20. The means 770 can be located at the top section of the top portion 760 with a lower section of the top portion 760 being attached to the top edge 712 of the main body 710. Any number of different techniques can be used to attach the top portion 760 to the main body 710 including but not limited to the use of stitching, fasteners (e.g., buttons, snaps, hook and loop material, zipper, etc.). It is within the scope of the present invention that the top portion 760 can be a separate fully contained part that is detachably attached to the main body 710. The insulation material (upper insulation body) 769 within the top portion 760 can thus represent loose stuffing that is contained within an internal pocket 765 formed in the top portion 760. An interface 763 is formed between the top portion 760 and the main body 710. Alternatively, the top portion 760 can be permanently attached to the main body 710 as by stitching.

The construction and placement of the top portion 760 is such that the top portion 760 can fold over the top surface of the keg 20 to thereby completely cover and enclose the entire keg within the jacket 700. This forms a closed insulated interior space in which the keg 20 sits. The height of the main body 710 is generally the same height of the keg 20 and thus, the top portion 760 is located at or slightly below, or slightly above the top surface of the keg 20.

The illustrative jacket 700 is formed of multiple materials that are located in different regions. For example, the closeable top portion 760 can be formed of a first material 769 and the body 710 that lies below the top portion 760 can be formed of a second material that has properties that are different than the first material. For example, the insulation material 769 can be formed of a non-foam panel material (e.g., a polyester fiberfill insulation material), while the main body 710 can be formed of a foam panel material (e.g., an elastomeric foam insulation).

The jacket 700 thus generally has a trash bag like construction in that the open top end of the product includes the means 770. When the means 770 is in the form of a cinching means, the means 770 includes a drawstring that is grasped and pulled by the user to close the top portion 760 and conversely, the drawstring 770 can be loosened to open up the top portion 760. The main body 710 thus represents a stiffer section of the cooling jacket 700, while the top portion 760 represents a more pliable section.

Unlike conventional keg jackets that at best only place insulation material around the side of the keg 20 (and do not extend the insulation across the top of the keg or the keg coupler), the cooling jacket 700 of the present invention is constructed so as to fully enclose the entire keg 20 within an insulating structure. More specifically, the keg 20 is not only received between the main body 710 but is also disposed below the top portion and is thereby completely enclosed within insulating material. This yields improved and optimal cooling since in the conventional designs, warming of the keg resulted from the open top nature of the jacket. In contrast, the closed nature of the present cooling jacket 700 in combination with the active cooling provided by the coolant flowing through the cooling jacket 700 as well as across the top of the keg 20 due to the construction of the keg feeder line 290.

The ends of the jacket body 710 can be detachably attached to one another using one or more fasteners, such as buttons, snaps, zipper(s), hook and loop material, etc.

As described herein, the design of the jacket 700 ensures uniform cooling.

Figure 6:
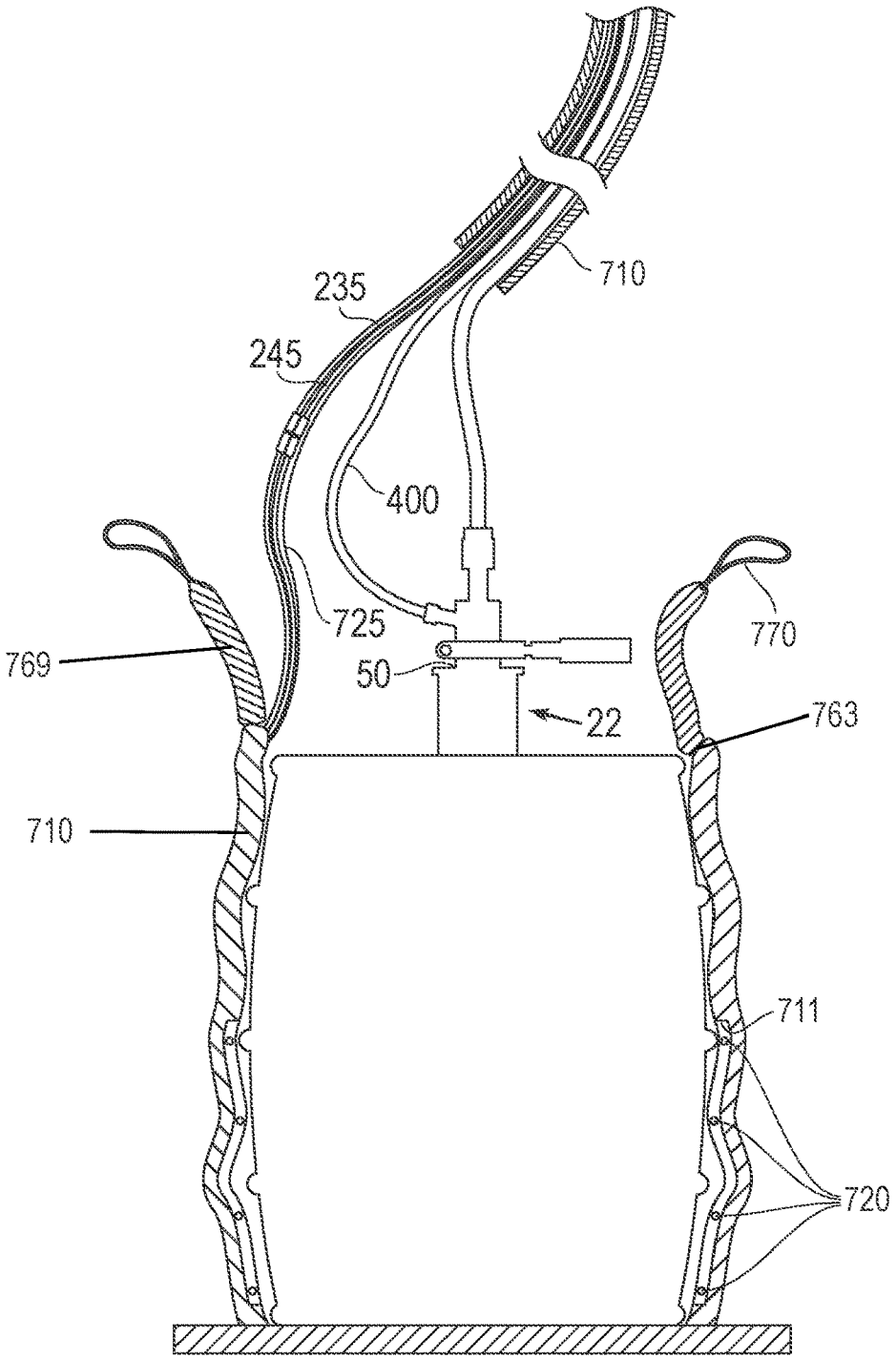
FIG. 6 is a top perspective view of the top portion of the cooling jacket.
Figure 7:
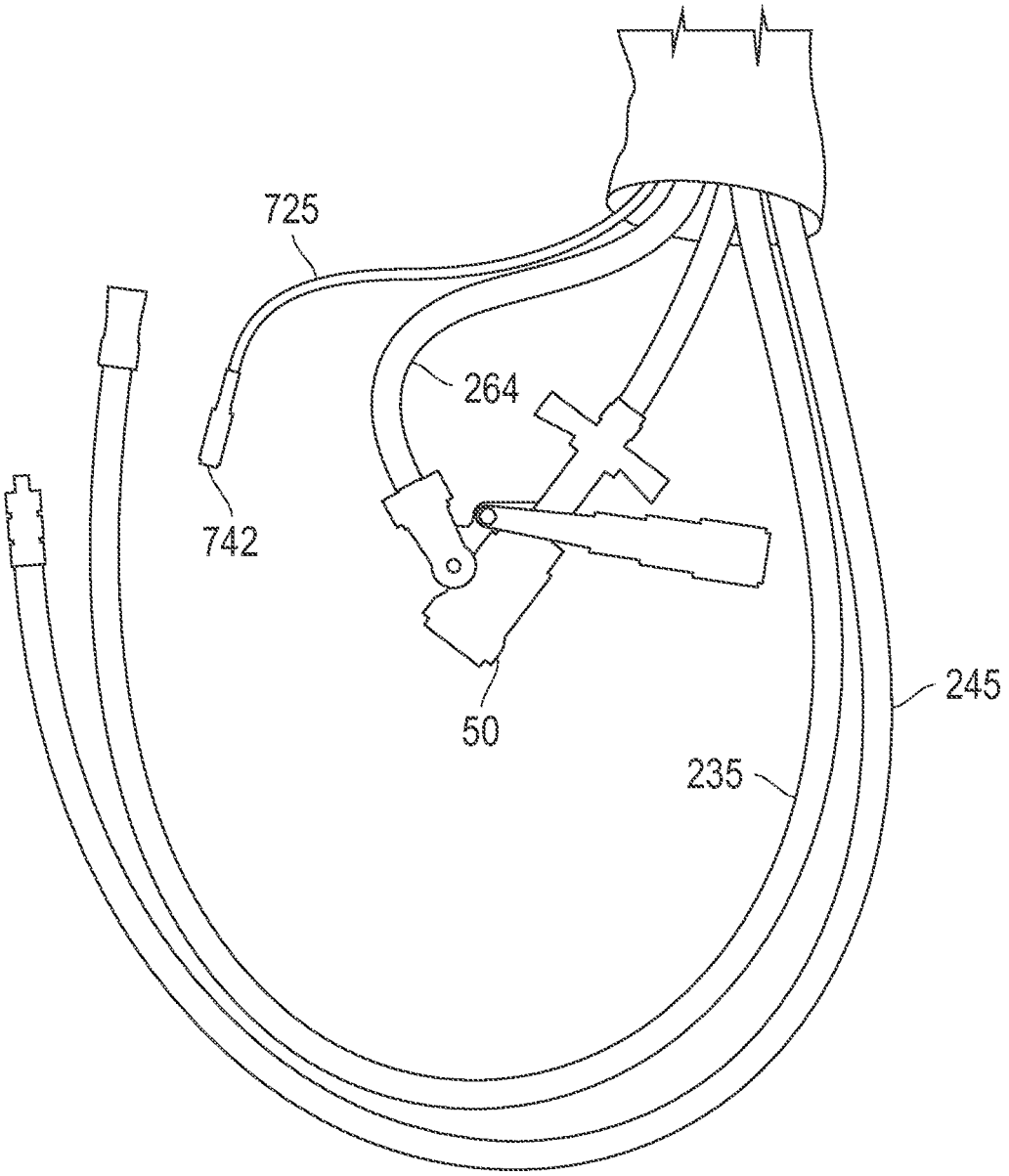
FIG. 7 is a side view of a keg coupler assembly with components of the cooling system.

FIGS. 6 and 7 show the keg feeder line 290 and the keg coupler 50. FIG. 6 shows a close-up of the keg coupler 50 attached to the keg 20 along with the branched lines 235, 245 and the gas line 262. A section of the top portion 760 is also shown. As shown, this section of the top portion 760 lies above the top of the keg 20. As can be seen from FIG. 7, the branched gas line 264 joins the keg coupler 50 and as shown, the gas line 264 intersects a side of the keg coupler 50 and the beer line 400 joins the keg coupler 50, such as at a top portion thereof. FIG. 7 shows the keg feeder line 290. The keg feeder line 290 receives the operative lines (conduits) of the cooling and dispensing system. As shown, the branched lines 235, 245, gas line 264, beer line 400, the temperature sensor line 725 are contained within the central open space 291 of the keg feeder line 290.

Figure 9:
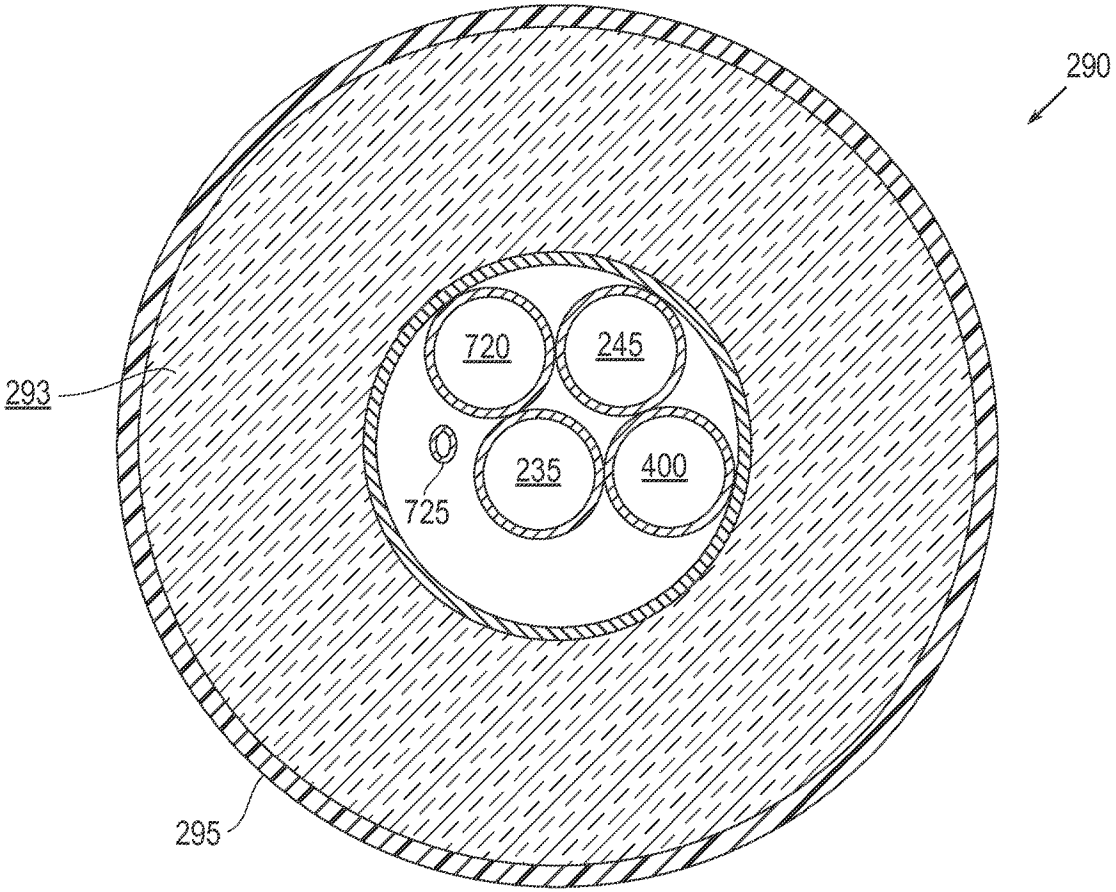
FIG. 9 is a cross-sectional view of a keg feeder line of the beverage dispensing system.

The keg feeder line 290 includes an insulation section 293 that surrounds the open space 291 for insulating the lines within the line. The insulation section 293 has an annular shape and can be formed of any number of different types of insulation so long as they are suitable for the intended application. In one embodiment, the insulation section 293 is formed of an elongated annular shaped elastomeric foam tube. A protective outer shell 295 can be formed around the insulation section 293. The protective outer shell 295 can be formed of a synthetic material, such as nylon or other polymeric material that forms a thin jacket or sleeve that surrounds the insulation section 293. As shown in FIG. 9, the branched line 235 that carries the coolant is preferably placed in contact with or in close proximity to the beer line 400 for direct cooling thereof. The branched line 235 and the beer line 400 can be coupled to one another using one or more fasteners. For example, the branched line 235 can be attached to the beer line 400 using a series of spaced clips of the like to ensure longitudinal contact between the branched line 235 and the beer line 400 for direct cooling thereof.

As will be appreciated, the keg feeder line 290 is bendable to allow it to be easily routed from the device 300 to one respective keg 20. Depending upon the storage location of the kegs 20, the keg feeder line 290 can be curved around other objects to attach to the respective keg.

Figure 8:
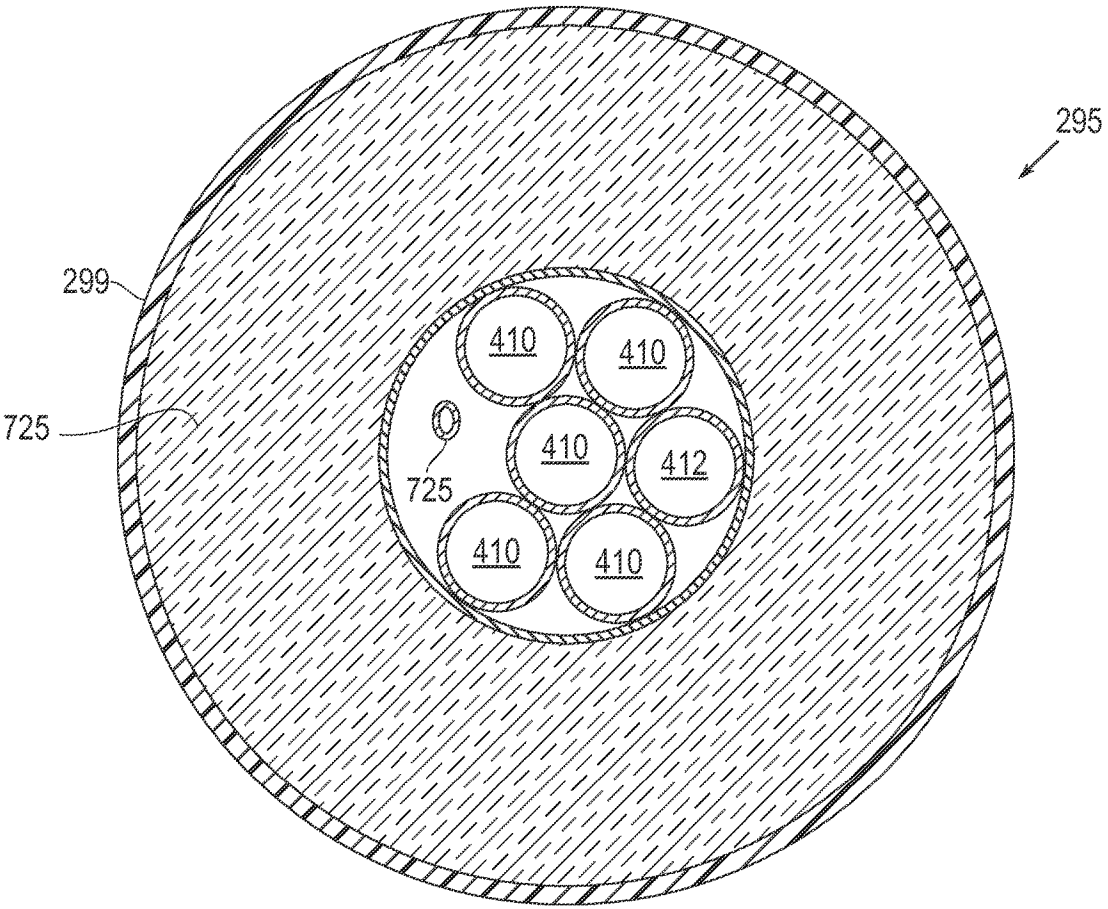
FIG. 8 is a cross-sectional view of a trunk line of the beverage dispensing system.

FIG. 8 shows the trunk line 295 which is similar to the keg feeder line 290 and has a sleeve or jacket that contains the beer lines 400. The trunk line 295 receives the beer lines 400 (in this case, the four beer lines 400) as well as the coolant line 410 and the return line 412 of the coolant. The inside of the trunk line 295 also includes the temperature sensor line 725 of the fifth temperature sensor 640.

The trunk line 295 includes an insulation section 298 that surrounds the lines. The insulation section 298 has an annular shape and can be formed of any number of different types of insulation so long as they are suitable for the intended application. In one embodiment, the insulation section 298 is formed of an elongated annular shaped elastomeric foam tube. A protective outer shell 299 can be formed around the insulation section 297. The protective outer shell 299 can be formed of a synthetic material, such as nylon or other polymeric material that forms a thin jacket or sleeve that surrounds the insulation section 297.

As shown in FIG. 8, the coolant line 410 that carries the coolant is preferably placed in contact with or in close proximity to each beer line 400 for direct cooling thereof. In the case of four beer lines 400 within the trunk line 295, the coolant line 410 is preferably centrally located with the beer lines 400 disposed circumferentially thereabout and preferably in contact therewith. The coolant line 410 and the beer lines 400 can be coupled to one another using one or more fasteners or can be tightly wrapped. Return line 412 is also included within the line 410.

Temperature sensor line 725 is also routed through the trunk line 295 to the fifth sensor 640 associated therewith or with the dispenser 40 (FIG. 1). The trunk line 295 is thus formed between the device 300 and the dispenser 40.

It will be appreciated that unlike conventional cooling systems, the cooling system 100 is configured such that each of the components thereof is chilled by means of the coolant and/or insulation. More specifically, the complete lengths of the beer lines 400 are chilled with coolant that flows through respective lines and further cooling is ensured by the insulated keg feeder lines and trunk line, as well as the insulation of the device 300 which houses the electronics, controller, etc.

Thus, the system 100 has the advantage that the entire flow path of the beer is chilled as a result of the coolant line being located both within the keg feeder line 290 and the trunk line 295 and when the beer lines 400 travel within the device 300 outside of both of these lines 290, 295, the interior of the device 300 is insulated and branched coolant lines 245 pass therethrough, thereby cooling the inside of the device 300. Thus, the entire length of the beer lines from the kegs 20 to the dispenser 40 are cooled to a target temperature (s), thereby not allowing the beer flowing therein to warm. The result is less foam being encountered at the dispenser 40 due to the temperature control over the beer lines 400 provided by the present invention.

As mentioned herein, the system 100 can be a programmable system and is configured such that each keg 20 can be chilled to a selected temperature that is entered at the user interface 500. The user interface 500 can configured to set temperatures at which one or more locations and/or pieces of equipment are to be chilled to. Exemplary set temperatures range from about 32° F. to about 65° F. It will be understood that there is prescribed degree of tolerance with respect to the set temperature and the actual observed temperature. For example, a tolerance of +/−1° F. can be observed.

This versatility and programmability allows the user to individualize and customize the cooling (chilling) temperature of each keg 20. As mentioned herein, different beers have different optimal cooling temperatures based in part on the type of beer being chilled (e.g., light or heavy beer) and other parameters and therefore, the ability to select the cooling temperature of the keg 20 is advantageous.

The system of FIG. 1 is intended for applications in which the kegs 20 are placed a considerable distance from the dispenser 40. For example, in this embodiment, the kegs 20 can be about 50 feet or more from the dispenser 40.

Figure 11:
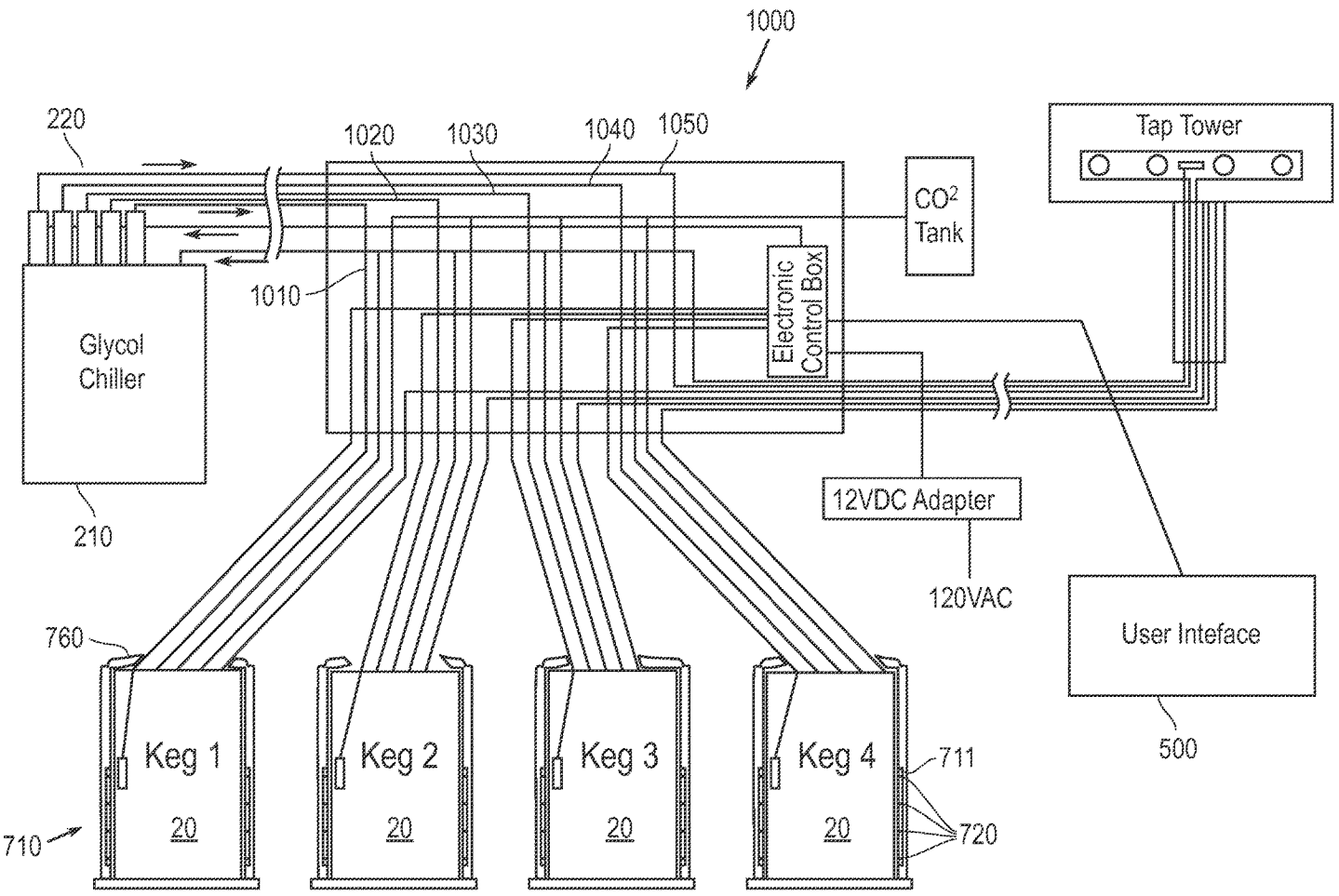
FIG. 11 is a schematic of a cooling system according to a second embodiment for use with a beverage dispensing system.

Now turning to FIG. 11 in which a system 1000 is shown. System 1000 is very similar to system 100 with the exception that instead of a branched coolant line scheme, the system 1000 included dedicated coolant lines for each kegs 20. More specifically, instead of a single coolant line from the coolant source 210, the system 1000 includes a plurality of coolant lines and in particular, the number of coolant lines is equal to the number of kegs 20 plus one for the tap tower cooling line. In the embodiment of FIG. 11, there are four coolant delivery lines 1010, 1020, 1030, 1040 that lead to four respective kegs 20. Coolant delivery line 1050 is the dedicated line for the trunk line 295. The design of system 1000 also allows a smaller coolant chiller (source) 210 to be used due to the use more efficient, smaller pumps. Thus, each keg feeder line 290 has a dedicated coolant delivery line and the trunk line 295 also has a dedicated coolant delivery line to ensure that the beer lines 400 are chilled along their entire routes.

The system 1000 also includes not one but a plurality of pumps 220 for pumping the delivery lines 1010, 1020, 1030, 1040. More specifically, each of the four coolant delivery lines 1010, 1020, 1030, 1040 includes a dedicated pump 220. The pump control line 225 that is operatively connected to the main controller 275 thus serves to control the individual pumps 220 for each of the four coolant delivery lines 1010, 1020, 1030, 1040. Since the pump 220 can be the means for controlling the flow of the coolant in one specific individual coolant delivery line 1010, 1020, 1030, 1040, the valves 250 can be eliminated.

It will be appreciated that the return line for the coolant can be a branched network and formed of branched coolant return lines 255 or return individually.

As shown, the rest of the system 1000 can be the same or similar to the system 100 as shown in FIG. 11.

Figure 12:
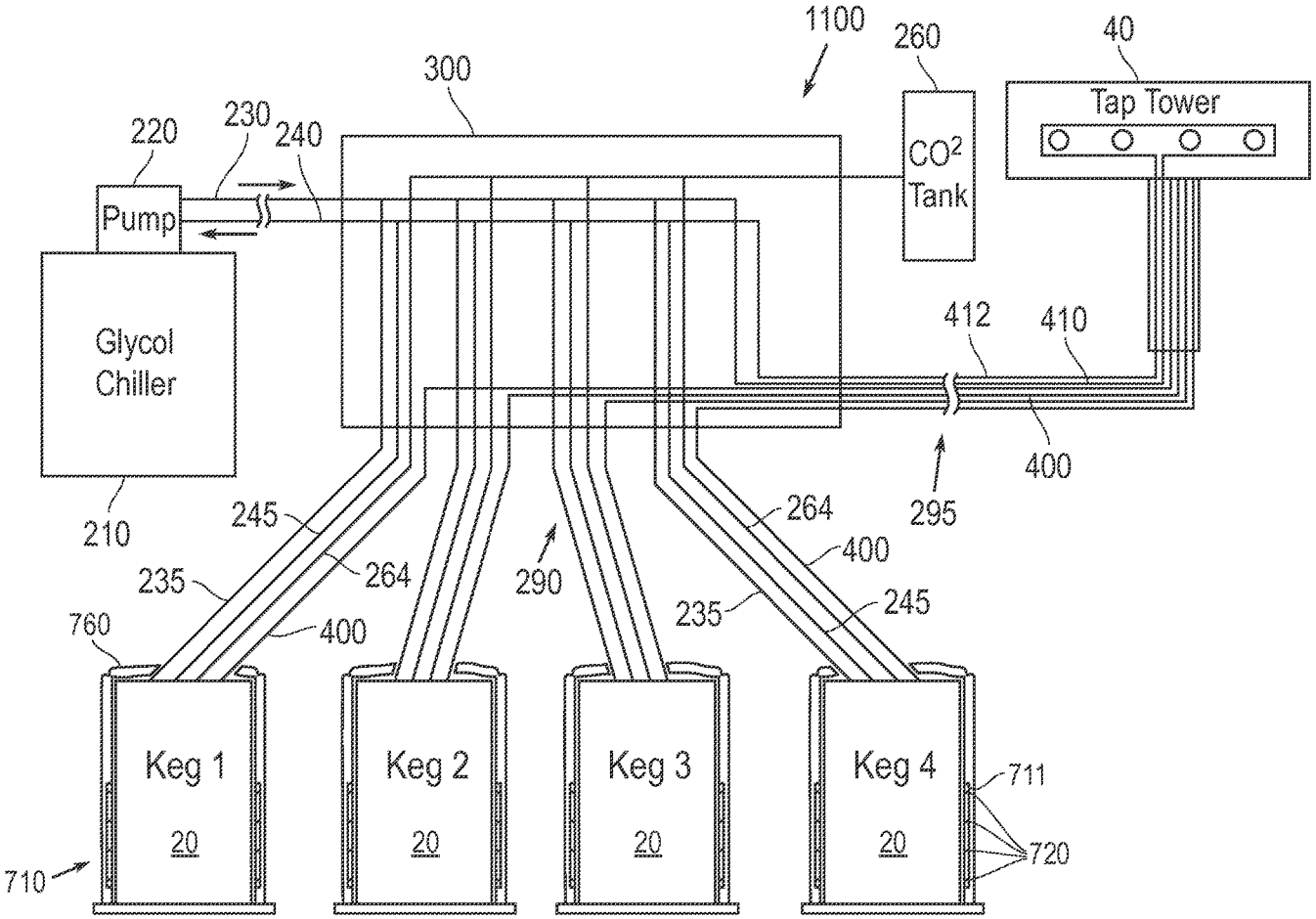
FIG. 12 is a schematic of a cooling system according to a third embodiment for use with a beverage dispensing system.

Now turning to FIG. 12 in which a system 1100 is shown. System 1100 is very similar to system 100 with the exception that the system 1100 does not includes the electronics, including the master controller 275 and the user interface 500, that form part of the system 100. The system 1100 thus still has the advantages of the system 100 in that the entire flow path of the beer is chilled as a result of the coolant line being located both within the keg feeder line 290 and the trunk line 295 and when the beer lines 400 travel within the device 300 outside of both of these lines 290, 295, the interior of the device 300 is insulated and branched coolant lines 245 pass therethrough, thereby cooling the inside of the device 300.

Distribution Box Temperature Control

The present invention includes a sixth control channel which is responsible for maintaining a set temperature in the distribution box 300. If the temperature of the distribution box 300 goes above a predetermined set point, a fan is engaged to enhance the cooling effect by the chilled manifold. The fan or other type of cooling mechanism is thus installed at least partially within or is in fluid communication with the inside of the distribution box 300 for controlled cooling thereof. The fan is thus operatively connected to a controller, which can be a main controller, that controls the entire system including the fan. The fan is thus a supplemental (backup) cooling mechanism that can be operated if the distribution box 300 is operating in less than ideal conditions (e.g., excessive temperature).

Insulating Mat

It will also be appreciated that an insulating mat can be used and the keg(s) can be placed thereon. For example, in FIG. 6, an insulating mat 799 is shown. The cooling jacket encompasses the entire keg except for the bottom. To address condensation and increase efficiency, the kegs can be placed on highly durable approximately 1" thick foam rubber mats 799 (e.g., similar to gym mats). This insulates the bottom of the keg and practically eliminates condensation. It also protects the floor from being damaged by the heavy steel kegs.

Cooling Jacket Extension

Figure 15B:
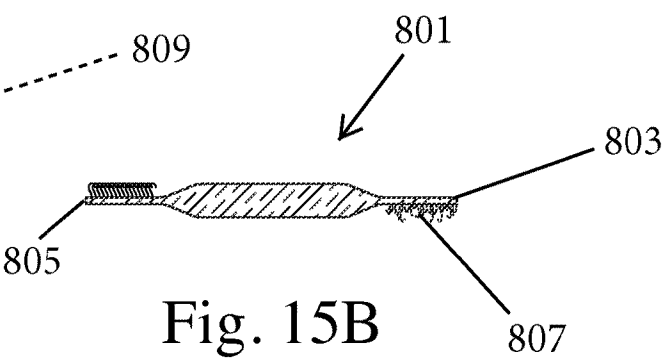
FIG. 15B is a bottom view of the jacket extension.
Figure 15A:
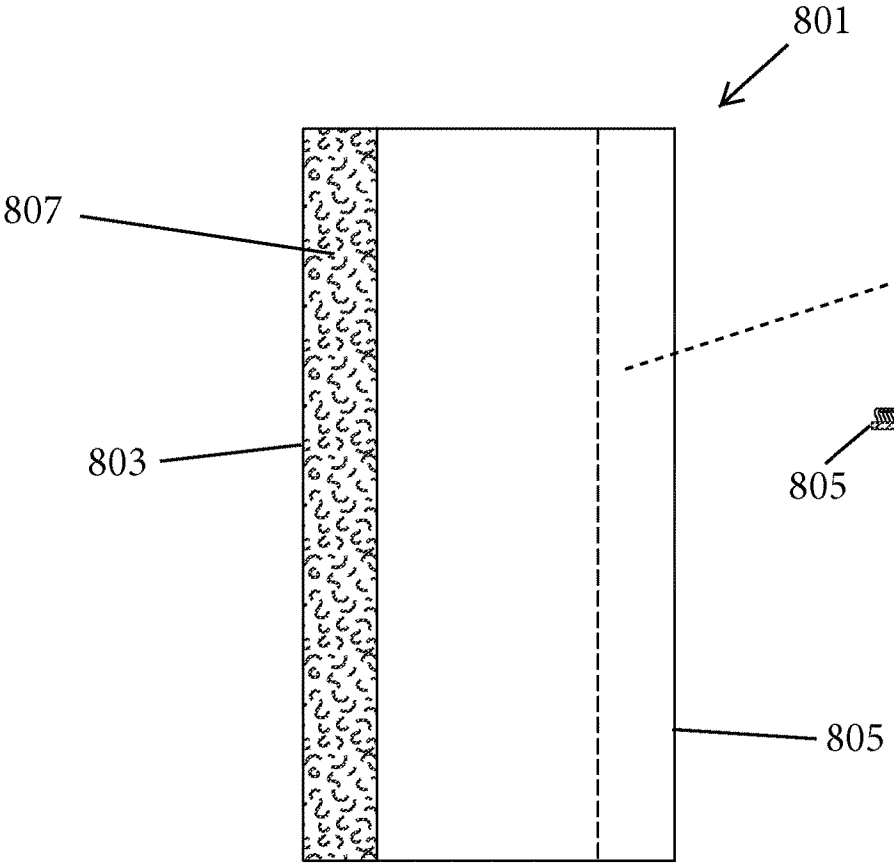
FIG. 15A is front elevation view of a jacket extension.

Now turning to FIGS. 15A and 15B, the present system can also utilize one or more cooling jacket extensions 801. There are some less common keg sizes out there and instead of manufacturing a different size cooling jacket for each one, extensions 801 can be provided for the smaller jackets so they can fit kegs with larger diameters. The jacket extension 801 is an elongated body that has a first side (edge) 803 and an opposing second side (edge) 805. The first side 803 includes a first fastener 807 and the second side 805 includes a second fastener 809. These fasteners 807, 809 thus mate to fasteners along the free ends of the jacket to thereby increase the coverage of the jacket (i.e., increase the size of the jacket). The extension 801 serves as a bridge between the free ends of the jacket.

Cooling Jacket—Cooling Coils

Figure 14:
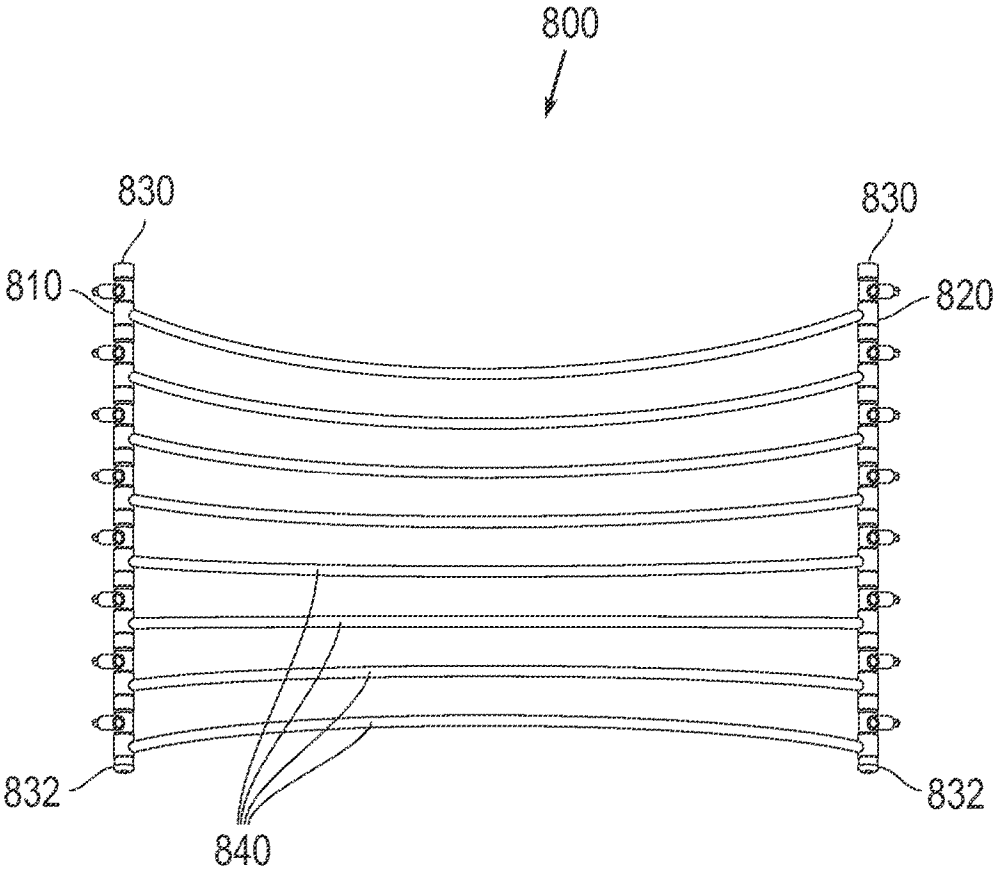
FIG. 14 is a side view of an alternative cooling coil design for incorporation into the cooling jacket.

FIG. 14 shows an alternative coil design for the cooling coils that are disposed inside of the jacket. Instead of using a serpentine coil that comprises a single flow path as shown in the previous figures, the design construction of FIG. 14 is comprised of two larger manifolds with many smaller tubes in between. More specifically, a cooling coil construction 800 is shown and includes first and second manifolds 810, 820. Each of the first and second manifolds 810, 820 includes a first end 830 and an opposite second end 832. The first ends 830 of the manifolds 810, 820 are open since they serve to receive the coolant in the case of the first manifold 810 and discharge the coolant in the case of the second manifold 820. The second ends 832 can be capped. There is a plurality of cross conduits 840 that extend between side ports of the two manifolds 810, 820 to allow the coolant to run between the manifolds 810, 820. The cross conduits 840 are flexible to allow the entire structure 800 to bend around the keg. The cross conduits 840 are generally parallel to one another.

It will be appreciated that in this design, the coolant enters the first end 830 of the first manifold 810 and flows across all of the cross conduits 840 to the second manifold 820 in which it flows to the first end 830 to exit the coil structure.

In yet another feature that is shown in FIG. 1, both the trunk line and the tap tower faucets are thermostatically controlled. For example, at least one temperature sensor 640 is disposed within the tap tower and at least one other temperature sensor 640 is disposed along the trunk line. These sensors 640 provide real time temperature data (measurements) of the respective locations and thus, any remedial action that is needed can be taken. Any number of different types of sensors 640 can be used.

Figure 16:
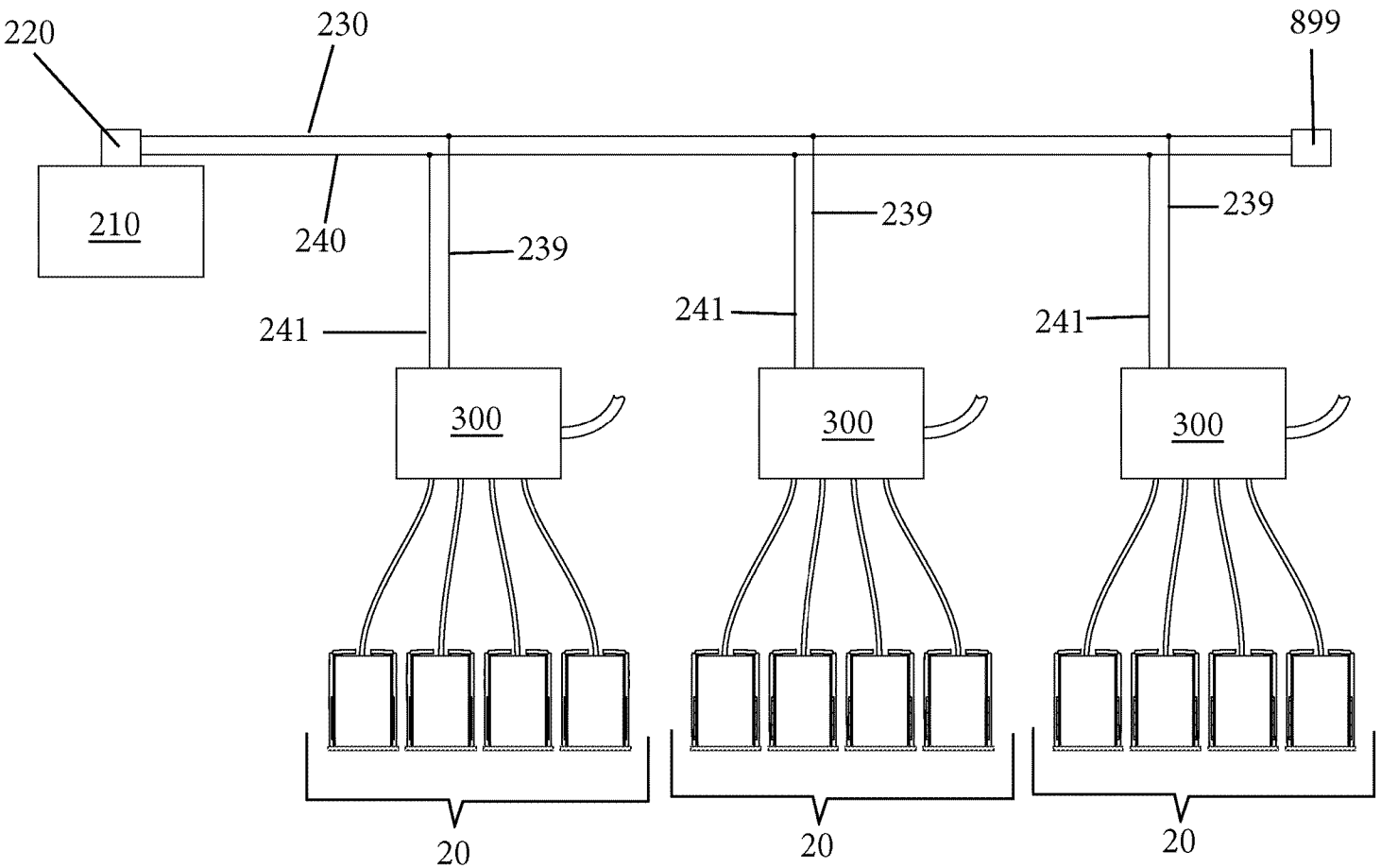
FIG. 16 is a schematic showing multiple cooling systems connected to a single chiller.
Figure 17:
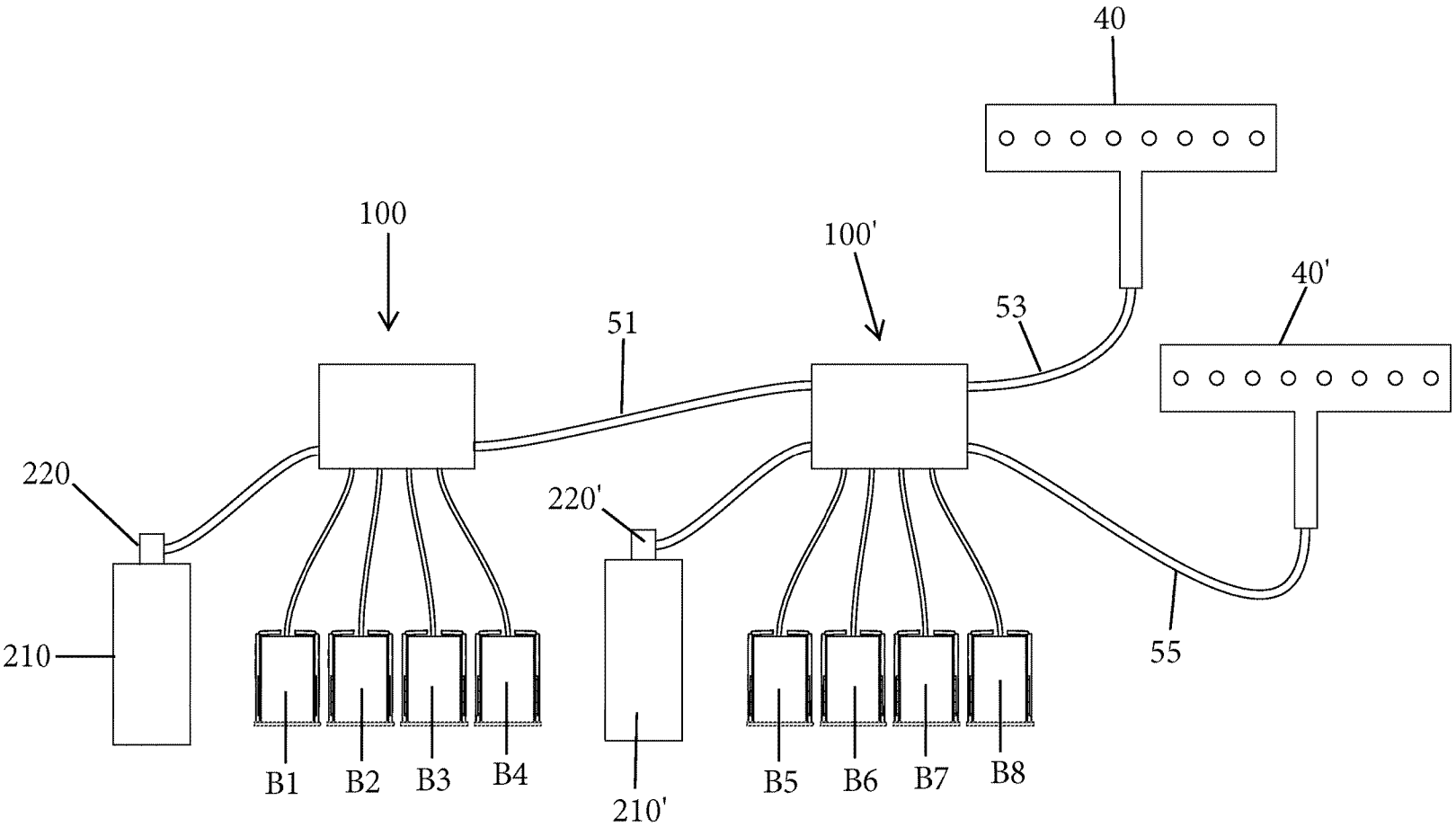
FIG. 17 is a schematic showing the ganging of two systems together.
Figure 18:
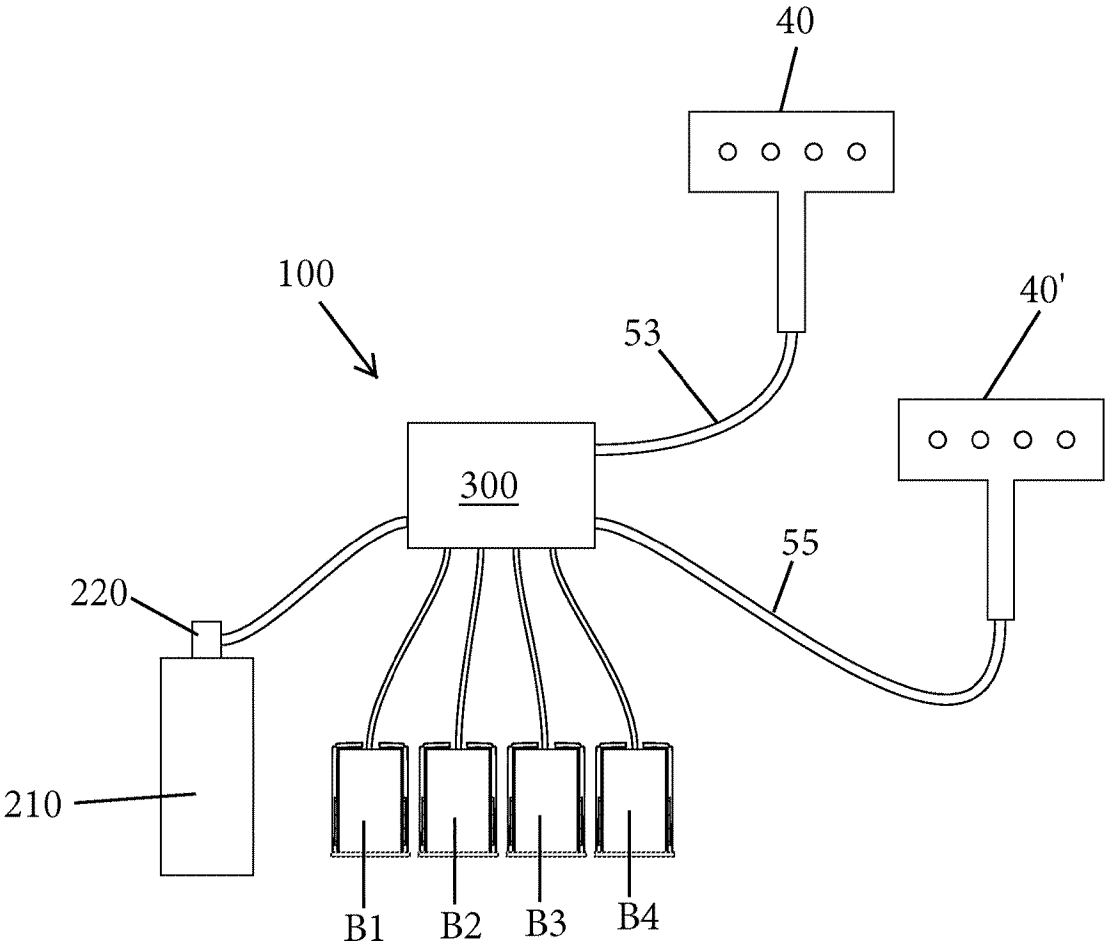
FIG. 18 is a schematic showing multiple tap towers with a single cooling system.

FIGS. 16-18 are schematics of different alternative system design. In particular, FIG. 16 shows one scheme in which multiple cooling systems, such as system 100, are connected to a single glycol chiller 210 (which in this case can be an oversized chiller). The glycol send and return lines 230, 240 are connected to each of the cooling systems 100 and as shown, each of the send and return lines 230, 240 is connected to a respective side lines 239, 241, respectively, that is fluidly connected to the distribution box 300 in the manner described above with respect to the discussion of the system 100. Pump 220 is also designed to accommodate the increased load of having plural systems 100 fluidly connected to one chiller 210.

This embodiment can also include a pressure by-pass safety 899 feature which can trip if excess pressure results in any one of the lines.

FIG. 17 is a schematic showing a different arrangement in which multiple systems 100, 100' are ganged together to allow delivery of multiple beverages to one or more locations. In the illustrated embodiment, the system 100 includes eight beverages, numbered B1, B2, B3, B4, B5, B6, B7 and B8. System 100 includes beverages B1, B2, B3, B4 that flow through one distribution box 300 and is chilled by a first chiller 210 powered by a first pump 220. System 100' includes beverages B5, B6, B7, B8 that flow through another distribution box 300' and is chilled by a second chiller 210' powered by a second pump 220'. A trunk line 51 connects the distribution box 300 to the distribution box 300' and carries beverages B1, B2, B3, B4.

Two trunk lines, namely, trunk line 53, 55 are connected to the distribution box 300'. Each of the trunk lines 53, 55 carry all eight beverages B1, B2, B3, B4, B5, B6, B7 and B8 to two different tap towers 40, 40'.

FIG. 17 thus shows an arrangement of ganging two systems 100, 100' together.

FIG. 18 is a schematic of one system with multiple tap towers. The system 100 is cooled by one chiller 210 powered by one pump 220 and in the illustrated embodiment, the distribution box 300 is connected to four beverages (B1, B2, B3, B4). The distribution box 300 is in fluid communication with one trunk line 53 that connects to one tap tower 40 and another trunk line 55 that connects to another tap tower 40'. Each tap tower 40, 40' delivers the four beverages.

In addition, it will be understood that the coolant control valves 250 can be located in the jacket itself instead of the manifold (distribution box 300) and be controlled by the system controller or a separate independent controller. When the valve 250 is disposed within the jacket, it operates in the same manner as when it is located in the manifold (box 300). For example, in FIG. 4A, the valve 250 can be disposed along line 720, such as at a location that is at or proximate to the first end 722.

The invention is described in detail with reference to particular embodiments thereof, but the scope of the invention is to be gauged by the claims that follow and also by those modifications that provide equivalent features to those that are claimed as such modifications are still within the spirit and scope of the invention.

What is claimed is:

1. A cooling jacket for a container holding a beverage comprising:

an outer shell configured so as to define a top portion and a bottom portion separated from the top portion;

a main body disposed within the bottom portion and having a top edge, an opposite bottom edge, an inner surface and an opposing outer surface, the main body being configured for placement around a side of the container, the main body having a first interior space for receiving the container, wherein the main body is formed of a first insulation material; and an openable and closeable upper body that comprises a pocket formed in the top portion of the shell and is for placement above and over a top of the container, the upper body being bendable relative to the main body about an interface between the upper body and the main body such that the upper body lies above the main body, the upper body of including a second insulation material that is separate and distinct from the first insulation material, the upper body having a closure for closing the upper body for enclosing a top of the container that is located within the cooling jacket;

wherein the main body includes a cooling line that has a free first end for receiving coolant and a free second end for returning the coolant, the free first and second ends extending above and being accessible along the top edge of the main body, while being spaced from the upper body.

2. The cooling jacket of claim 1, wherein the main body is formed of a foam panel structure and the upper body is formed of loose insulation material.

3. The cooling jacket of claim 1, wherein the main body comprises an elastomeric foam insulation and the upper body comprises polyester fiberfill insulation material.

4. The cooling jacket of claim 1, wherein the coolant comprises a glycol composition.

5. The cooling jacket of claim 1, further including a temperature sensor disposed along the inner surface and including a first temperature sensor line that terminates in a first temperature connector that is accessible along the main body.

6. The cooling jacket of claim 5, wherein the free first end includes a first connector and the second free end includes a second connector, each of the first connector, second connector and first temperature connector comprises a quick connector.

7. The cooling jacket of claim 1, wherein at least a substantial portion of the cooling line lies within a bottom half of the main body.

8. The cooling jacket of claim 7, wherein the cooling lines comprises two parallel line sections that terminate in the free first and second ends and extend vertically relative to the main body and a plurality of coiled sections that extend horizontally relative to the main body.

9. The cooling jacket of claim 8, wherein the coiled sections are exclusively located in the bottom half of the main body.

10. The cooling jacket of claim 8, wherein the bottom half of the main body includes a recessed portion in which the coiled sections are disposed.

11. The cooling jacket of claim 1, wherein the means for closing the upper body comprises a cinching means.

12. The cooling jacket of claim 11, wherein the cinching means comprises a drawstring.

13. The cooling jacket of claim 1, wherein at least a substantial portion of the cooling line lies within one half of the main body as measured from the top edge to the bottom edge, the one half of the main body that is free of the cooling lines extends from the top edge to the bottom edge.

14. The cooling jacket of claim 1, wherein the main body and upper body are configured to enclose a keg which comprises the container.

15. The cooling jacket of claim 1, wherein the main body includes a cooling line assembly comprising a first cooling line manifold and a second cooling line manifold, each of the first and second cooling line manifolds includes a plurality of side ports, a first open end and a closed second end, the cooling line assembly further including a plurality of cross conduits that are fluidly connected at their ends to the side ports of the first and second cooling line manifolds.

16. The cooling jacket of claim 1, further including a jacket extension which comprises an elongated body having a first side and an opposite second side, the first side having a first extension fastener formed therealong and the second side having a second extension fastener formed therealong, the first extension fastener configured to matingly attach to a complementary jacket fastener formed on one of the free ends of the jacket, the second extension fastener configured to matingly attach to another complementary jacket fastener formed on the other free end of the jacket.

17. The cooling jacket of claim 1, wherein the cooling line includes a coolant control valve for controlling flow of the coolant through the cooling line of the jacket body.

* * * * *